US012214944B2

(12) United States Patent
Presche

(10) Patent No.: US 12,214,944 B2
(45) Date of Patent: Feb. 4, 2025

(54) CLOSURE DEVICE FOR A CONTAINER

(71) Applicant: RPC Bramlage GmbH, Lohne (DE)

(72) Inventor: Martin Presche, Dinklage (DE)

(73) Assignee: RPC Bramlage GmbH, Lohne (DE)

( * ) Notice: Subject to any disclaimer, the term of this patent is extended or adjusted under 35 U.S.C. 154(b) by 325 days.

(21) Appl. No.: 17/613,525

(22) PCT Filed: May 27, 2020

(86) PCT No.: PCT/EP2020/064700

§ 371 (c)(1),
(2) Date: Nov. 23, 2021

(87) PCT Pub. No.: WO2020/239834

PCT Pub. Date: Dec. 3, 2020

(65) Prior Publication Data

US 2022/0258936 A1 Aug. 18, 2022

(30) Foreign Application Priority Data

May 27, 2019 (DE) ..... 10 2019 114 081.1
Oct. 25, 2019 (GB) ..... 1915492
Mar. 6, 2020 (GB) ..... 2003293

(51) Int. Cl.
*B65D 51/28* (2006.01)
*B65D 43/02* (2006.01)

(52) U.S. Cl.
CPC ..... *B65D 51/2892* (2013.01); *B65D 43/0231* (2013.01)

(58) Field of Classification Search
CPC ..... B65D 41/0471; B65D 51/2892; B65D 41/0428; B65D 41/0485; B65D 51/2857;
(Continued)

(56) References Cited

U.S. PATENT DOCUMENTS 3,924,741 A * 12/1975 Kachur ..... B65D 51/2892 604/416
4,386,696 A * 6/1983 Goncalves ..... B65D 81/3222 215/DIG. 8

(Continued)

FOREIGN PATENT DOCUMENTS

DE 10 2014 107 550 A1 11/2015
DE 10 2018 105 321 A1 9/2018

(Continued)

OTHER PUBLICATIONS

International Search Report of PCT/EP2020/064700, mailed Nov. 27, 2020.

*Primary Examiner* — Steven A. Reynolds
*Assistant Examiner* — Prince Pal
(74) *Attorney, Agent, or Firm* — Collard & Roe, P.C.

(57) ABSTRACT

A closure device for a container with a container opening has a lid element for closing the container opening, a chamber assigned to the lid element and an inner housing. The chamber and the inner housing have closing and opening elements that correspond to one another. The chamber locks with the inner housing, the lock with the inner housing being offset radially inwards in respect of a vertical of the closure device over a greatest width of the chamber in the offset direction. In order to specify a closure device which allows emptying of the chamber as the lid element is removed in an easy-to-handle fashion, with further preferred favorable manufacturability of the closure device, the lock in the vertical direction is designed separately from a shoulder section of the inner housing formed on the base side under the lock.

11 Claims, 15 Drawing Sheets

(58) Field of Classification Search
CPC .... B65D 55/02; B65D 2555/02; B65D 81/32; B65D 51/3222; B65D 51/3216; B65D 25/08; B65D 81/326; B65D 81/3211; B65D 51/28
USPC ..... 206/528, DIG. 8; 215/10
See application file for complete search history.

(56) References Cited

U.S. PATENT DOCUMENTS 4,793,475 A * 12/1988 Itzel ..... B65D 51/2814 215/DIG. 8
4,903,865 A * 2/1990 Janowitz ..... B65D 51/2842 604/416
5,277,303 A * 1/1994 Goyet ..... B65D 81/3211 215/DIG. 8
5,465,835 A * 11/1995 Schumacher ..... B65D 81/3222 215/DIG. 8
5,811,060 A * 9/1998 Laguna Valderrama ..... B65D 81/3222 215/DIG. 8
5,908,107 A * 6/1999 Baudin ..... B65D 81/3211 215/DIG. 8
D415,959 S * 11/1999 Antoine ..... D9/724
6,003,728 A 12/1999 Elliott
6,135,275 A * 10/2000 Kelders ..... B65D 81/3211 215/DIG. 8
6,527,109 B2 * 3/2003 Schoo ..... B65D 51/2807 426/115
6,571,994 B1 * 6/2003 Adams ..... B65D 51/2835 222/521
7,055,685 B1 * 6/2006 Patterson ..... B65D 51/2892 215/DIG. 8
7,070,046 B2 * 7/2006 Cho ..... B65D 51/2878 215/DIG. 8
7,261,226 B2 * 8/2007 Adams ..... B65D 51/2835 206/532
7,337,921 B2 * 3/2008 Ma ..... B65D 51/285 426/112
7,562,782 B2 * 7/2009 Yorita ..... B65D 51/2842 215/DIG. 8
7,588,142 B1 * 9/2009 Bush ..... B65D 51/2857 215/DIG. 8
7,861,854 B2 * 1/2011 Sharon ..... B65D 51/2864 215/DIG. 8
7,861,855 B2 * 1/2011 Casey ..... B65D 81/3222 206/568
8,226,126 B2 * 7/2012 Johns ..... F16L 29/005 285/3
8,356,711 B2 * 1/2013 Canziani Hoffa . B65D 51/2807 206/535
8,511,465 B2 * 8/2013 Seelhofer ..... B65D 51/2821 426/112
8,672,154 B2 * 3/2014 Seelhofer ..... B65D 51/2821 222/82
8,672,156 B2 * 3/2014 Martinovic ..... B65D 51/2892 215/253
9,016,488 B1 * 4/2015 Peres ..... A61J 9/008 215/11.1
9,434,519 B2 * 9/2016 Stripp ..... B65D 47/20
9,592,940 B2 * 3/2017 Nyambi ..... B65D 51/2835
9,758,281 B2 * 9/2017 Glaser ..... B65D 41/3447
9,902,538 B2 2/2018 Presche
10,029,832 B2 * 7/2018 Isogai ..... B65D 47/36
10,086,980 B2 * 10/2018 Isogai ..... B65D 39/08
10,392,171 B2 * 8/2019 Pelamo ..... B65D 41/0407
10,414,563 B2 * 9/2019 Yang ..... B65D 85/72
10,472,142 B2 * 11/2019 Presche ..... B65D 51/2892
10,512,926 B2 * 12/2019 Goettke ..... B05B 11/1074
10,604,313 B2 * 3/2020 Presche ..... B65D 51/2835
10,647,485 B2 * 5/2020 Presche ..... B65D 41/28
10,723,537 B2 * 7/2020 Son ..... B65D 81/3222
11,185,877 B2 * 11/2021 Goettke ..... B05B 11/0072
11,198,546 B2 * 12/2021 Guery ..... B65D 51/285
11,279,545 B1 * 3/2022 Tarrant ..... A45D 34/00
11,426,734 B2 * 8/2022 Blair ..... B01L 3/523
11,535,433 B2 * 12/2022 McNamara ..... B65D 51/1622
11,565,860 B2 * 1/2023 Presche ..... B65D 51/2878
11,752,513 B2 * 9/2023 Goettke ..... B05B 15/30 222/95
2002/0185389 A1 * 12/2002 Kelders ..... B65D 81/3211 206/219
2003/0222102 A1 * 12/2003 Cho ..... B65D 51/2842 222/129
2005/0016875 A1 * 1/2005 Rodriguez ..... B65D 51/2814 206/219
2005/0211579 A1 * 9/2005 Makita ..... B65D 51/2842 206/219
2007/0017830 A1 * 1/2007 Neumeyer ..... B65D 51/2835 206/219
2007/0119727 A1 * 5/2007 Cho ..... B65D 51/2892 206/217
2007/0199839 A1 * 8/2007 Sharon ..... B65D 51/2864 206/219
2007/0280042 A1 * 12/2007 Yamanaka ..... B65D 51/2835 366/185
2007/0289670 A1 * 12/2007 Johns ..... B65D 81/3211 141/383
2008/0078200 A1 * 4/2008 Roth ..... A47J 43/27 220/253
2009/0139882 A1 * 6/2009 DeJonge ..... B65D 51/2892 222/129
2009/0236244 A1 * 9/2009 Frutin ..... B65D 51/2892 206/219
2009/0321286 A1 * 12/2009 Frutin ..... B65D 51/2892 206/219
2012/0017766 A1 * 1/2012 Anson ..... B65D 47/243 99/290
2012/0024862 A1 * 2/2012 Otsuka ..... B65D 81/3211 220/502
2012/0187071 A1 * 7/2012 Martinovic ..... B65D 51/2892 215/250
2012/0223100 A1 * 9/2012 Simonian ..... B65D 51/2892 222/145.1
2013/0306499 A1 * 11/2013 Lee ..... B65D 51/2864 206/221
2014/0110281 A1 * 4/2014 Chen ..... B65D 51/2892 206/219
2014/0251938 A1 * 9/2014 Rose ..... B65D 51/242 215/6
2014/0263154 A1 * 9/2014 Musumeci, Jr. ... B65D 51/2892 215/250
2014/0305817 A1 * 10/2014 Guery ..... A61J 9/00 206/221
2014/0361016 A1 * 12/2014 Moreau ..... B65D 51/28 426/115
2015/0027913 A1 * 1/2015 P. J. ..... B65D 81/3211 53/428
2015/0336724 A1 * 11/2015 Simonian ..... B65D 47/243 222/545
2016/0317388 A1 * 11/2016 Bhargava ..... A61K 9/10
2017/0050784 A1 * 2/2017 Presche ..... B29C 45/14467
2017/0259982 A1 * 9/2017 Nickerson ..... B65D 41/26
2018/0044080 A1 * 2/2018 Presche ..... B65D 41/28
2018/0127171 A1 * 5/2018 Jung ..... B65D 51/28
2019/0084738 A1 * 3/2019 Yang ..... B65D 41/0428
2020/0017263 A1 * 1/2020 Presche ..... B65D 51/2892
2020/0087037 A1 * 3/2020 Bores ..... B65D 41/0478
2020/0361694 A1 * 11/2020 Lee ..... B65D 81/3222
2021/0002048 A1 * 1/2021 Presche ..... B65D 51/2892
2021/0061530 A1 * 3/2021 Presche ..... B65D 51/2878
2021/0253319 A1 * 8/2021 Sitwell ..... B65D 51/2864
2022/0000305 A1 * 1/2022 Bloomfield ..... B65D 51/28
2022/0002065 A1 * 1/2022 Lombard ..... B65D 81/3211
2022/0002066 A1 * 1/2022 Lombard ..... B65D 41/04
2022/0002067 A1 * 1/2022 Lombard ..... B65D 81/3211
2022/0002068 A1 * 1/2022 Lombard ..... B65D 41/04
2022/0024672 A1 * 1/2022 Xue ..... B65D 51/2892
2022/0063881 A1 * 3/2022 Bouteloup ..... B65D 51/2821
2022/0081183 A1 * 3/2022 Tarrant ..... B65D 81/3211
2022/0126314 A1 * 4/2022 Presche ..... B05B 11/1033

(56) References Cited

U.S. PATENT DOCUMENTS

| | | | | |
|---|---|---|---|---|
| 2022/0153500 | A1* | 5/2022 | Lee | B65D 51/2835 |
| 2022/0258153 | A1* | 8/2022 | Caubet Canals | B01L 3/5635 |
| 2022/0258936 | A1* | 8/2022 | Presche | B65D 43/0231 |

FOREIGN PATENT DOCUMENTS

| | | | |
|---|---|---|---|
| EP | 0 064 310 | A2 | 11/1982 |
| WO | 2007/129116 | A1 | 11/2007 |
| WO | 2012/175934 | A2 | 12/2012 |

* cited by examiner

CLOSURE DEVICE FOR A CONTAINER

CROSS REFERENCE TO RELATED APPLICATIONS

This application is the National Stage of PCT/EP2020/064700 filed on May 27, 2020, which claims priority under 35 U.S.C. § 119 of German Application No. 10 2019 114 081.1 filed on May 27, 2019, GB Application No. 1915492.1 filed on Oct. 25, 2019, and GB Application No. 2003293.4 filed on Mar. 6, 2020, the disclosures of which are incorporated by reference. The international application under PCT article 21(2) was not published in English.

TECHNICAL FIELD

The invention initially pertains to a closure device for a container with a container opening, wherein the closure device has a lid element for closing the container opening, a chamber assigned to the lid element and an inner housing, wherein the chamber and the inner housing furthermore have closing means and opening means that correspond to one another and interact with one another in such a way that a medium contained in the chamber can exit into the container due to a movement of the lid element relative to the inner housing, wherein the chamber furthermore has a freely projecting closure edge, which in the usage state is directed into a container interior, circumferentially extends around the central axis of the chamber in an annular manner and in the closed state interacts with the inner housing in a closing manner, wherein the inner housing forms a chamber bottom that is delimited by the closure edge, wherein the chamber furthermore is interlocked with the inner housing, and wherein the interlock with the inner housing is with respect to a vertical central axis of the closure device offset radially inward in relation to a greatest width of the chamber in the offset direction.

The invention also pertains to a closure device for a container with a container opening, wherein the closure device has a lid element for closing the container opening, a chamber assigned to the lid element and an inner housing, wherein the chamber and the inner housing furthermore have closing means and opening means that correspond to one another and interact with one another in such a way that a medium contained in the chamber can exit into the container due to a movement of the lid element relative to the inner housing, wherein the chamber furthermore has a freely projecting closure edge, which in the usage state is directed into a container interior, circumferentially extends around the central axis of the chamber in an annular manner and in the closed state interacts with the inner housing in a closing manner, wherein the inner housing forms a chamber bottom that is delimited by the closure edge, wherein the chamber furthermore is composed of two parts and has a partition plane that extends perpendicular to a vertical central axis of the closure device, and wherein the partition plane extends through an overlapping section of a lower part of the chamber.

PRIOR ART

Closure devices of the above-described type are known from the prior art. They serve for closing a container and for simultaneously providing a chamber for the separate storage of liquid or powdery mediums, for example tea essences or the like, such that these mediums do not immediately come in contact with and/or are mixed with the contents of the container, for example water, when the container is filled, but only at the moment, at which the closure device is removed from the container. This is typically the moment, at which the contents of the container should be consumed.

For example, publication WO 2007/129116 A1 pertains to a closure device of the above-described type, which upon opening a container closed with this closure device releases a supplemental liquid located in the chamber into the container. The closure device has a lid element, a chamber and an inner housing. The inner housing has a discharge opening, into which a closing means connected to the inner housing engages in a sealing manner. The closing means may be realized in a plug-shaped manner. The lid element and the inner housing can be connected to one another by means of a screw thread, wherein the lid element can be raised relative to the inner housing from a closed position, in which the closing means closes the discharge opening of the chamber, into a discharge position, in which the closing means is at least partially retracted from the discharge opening, in order to thereby produce a passage from the chamber into the main liquid space of the container. In this way, the medium stored in the chamber can exit into the container, where it is mixed with the medium located in the container.

It is furthermore known, e.g. from DE 10 2018 105 321 A1, to realize the closing means by the wall of the chamber as such, particularly by the region of the freely projecting closure edge, which in the usage state is directed into the container interior and circumferentially extends around the central axis of the chamber in an annular manner. This closure edge interacts with the inner housing at least in the closed position. In order to release the discharge opening in the bottom of the inner housing, the closure edge can be displaced into a discharge position, particularly as a result of an axial or also rotary displacement of the closure edge relative to the inner housing. According to an embodiment, the chamber is interlocked with the inner housing above a lower tapered section that transforms into opening means.

DE 10 2014 107 550 A1 discloses a closure device, in which a downwardly open gap between the chamber and a chamber end piece, which follows the chamber inward, is filled with an injected plastic seal.

SUMMARY OF THE INVENTION

Based on the prior art according to DE 10 2018 105 321 A1, the invention initially aims to disclose a closure device, which particularly allows a cost-efficient manufacture and convenient handling.

This objective is attained with a closure device in which it is proposed that the interlock is in the vertical direction designed separately from a shoulder section of the inner housing, which is formed on the bottom side underneath the interlock and functionally connected to the container opening.

Based on the prior art according to DE 10 2014 107 550 A1, the invention furthermore aims to produce an advantageous connection between parts of the chamber.

This objective is attained with a closure device, in which it is proposed that the two parts are welded to one another in the partition plane, wherein the welded joint is produced by means of a supplementary section that is connected to both parts and produced by overmoulding, that the supplementary section is designed annularly, and that a cross-sectionally outer circumferential wedge surface is cut into the edge region of the upper part in order to accommodate the supplementary section produced by overmoulding the region or that the supplementary section is with respect to a cross section protracted radially outward and accordingly protrudes beyond the facing outer edge delimitation of the upper and the lower part.

An improvement is achieved, particularly with respect to emptying the chamber in the course of a removal of the lid element, due to the proposed novel interlock between the chamber and the inner housing. The inner housing is functionally connected to the container opening of the container, particularly in the form of a frictionally engaged connection, by means of the shoulder section, optionally and preferably while forming a seal relative to the container opening.

An advantageous assembly of the chamber and the inner housing and also of the unit consisting of the inner housing and the chamber with the container furthermore is achieved as a result of the proposed design.

In this case, the interlock may be offset radially inward by a dimension that corresponds to approximately one-sixth to one-half, e.g. to approximately one-fourth, of the greatest width of the chamber transverse to the vertical direction of the closure device.

The welded joint is produced with the supplementary section that is connected to the two parts and produced by overmoulding. In this case, the supplementary section preferably can consist of the same plastic material as the two parts forming the chamber or of a plastic material that makes it possible to produce a welded joint with the two parts. In another embodiment, for example, the supplementary section may contain polybutylene terephthalate.

In addition to producing an optionally positive connection between the supplementary section and the two parts of the chamber, the overmoulding process advantageously also makes it possible to produce a welded joint between the two parts and the supplementary section, optionally also against one another, in the course of the overmoulding process.

In another embodiment, the two parts of the chamber may also be directly welded to one another in the partition plane. An ultrasonic welding process is preferred in this respect.

The welding point, which is optionally produced by using a supplementary section, basically may be outwardly covered by a section of the tank, particularly the upper part of the tank, such that the welding point (or the circumferential welding region) is not visible from outside. In this case, the upper part can extend beyond the welding point in an apron-like manner, preferably vertically downward with respect to a normal usage position.

The preferred additional plug-in connection between the upper and the lower part particularly may serve for a correct alignment of the parts relative to one another prior to and in the course of the welding process. Furthermore, an increased stability in the welding region can thereby be achieved.

According to the invention, it would also be possible that the interlock is in the vertical direction designed separately from a shoulder section of the inner housing formed on the bottom side underneath the interlock and that the two parts of the chamber are welded to one another in the partition plane, wherein the welded joint is produced by means of a supplementary section that is connected to both parts and produced by overmoulding or wherein the welded joint is outwardly covered by the upper part of the tank, and wherein the upper part and the lower part of the tank furthermore are connected by means of a plug-in connection.

The two-part composition of the chamber proves advantageous in terms of manufacturing, as well as in terms of handling. As a result of this design, a lower part of the two-part chamber may comprise constructive means, which could not be produced at all or only produced with significant additional effort in a one-piece design of such a chamber. For example, the two parts of the chamber may be manufactured of different materials. In the preferred manufacture of the chamber of a plastic material, it is therefore also possible to use at least partially different plastics or plastic mixtures and optionally also different manufacturing methods, for example a plastic blow moulding process for one part of the chamber, e.g. a pot-like region of the chamber, and optionally a plastic injection moulding process for manufacturing the other part that serves for fixing the chamber as a whole on the inner housing and/or the lid element.

The lower part of the chamber particularly may provide the closing means for interacting with the inner housing in this case.

In comparison with a one-piece chamber, which preferably is manufactured in a plastic blow moulding process, this also makes it possible to achieve more favorable and, in particular, significantly smaller diametric dimensions in the region of the closing means of the chamber, which in turn advantageously affect the frictional forces between the chamber and the inner housing on the one hand and between the inner housing and a facing inner surface of the container neck on the other hand. As a result of the two-part design of the chamber, the diameter ratio of the frictional surfaces between the closing means and the inner housing, as well as between the inner housing and the facing inner wall of the container neck, can be advantageously influenced with respect to the required preservation of the frictional engagement between the inner housing and the container neck in the course of an initial rotary opening movement of the closure device.

The two-part design of the chamber also makes it possible to achieve an advantageous arrangement of the interlocks between the inner housing and the chamber, as well as between the chamber and the lid element, on such different diameters that their catch projections and catch recesses extend without overlapping one another in a projection into a common plane transverse to the vertical axis.

According to another preferred embodiment, the interlock between the inner housing and the chamber may be formed on a free-standing cylinder section of the inner housing. For example, such a free-standing cylinder section may freely extend axially into the circumferential wall of the inner housing, which in other respects is preferably realized in a pot-shaped manner on its bottom side, starting from a root region of the shoulder section, particularly in such a way that an end of the cylinder section, which in the normal usage position is directed vertically upward, preferably is neither supported radially inside nor radially outside.

According to a potential embodiment, the above-described cylinder section furthermore may extend at a distance radially inside and at least approximately concentric to a section of the shoulder section.

In another embodiment, the inner housing may at the same time have an internal thread for interacting with an external thread of the container, as well as a sealing lip that is spaced apart from the internal thread radially inward. The sealing lip preferably can extend essentially concentric to the region of the inner housing comprising the internal thread. The container neck, on which the closure device is retained by means of a screw connection, extends between the internal thread and the sealing lip in the associated position. A free end of the sealing lip, which points in the axial direction of the closure device, preferably is directed downward in the normal usage position and accordingly directed opposite to the orientation of the free end of the above-described cylinder section.

The sealing lip may be realized in radial overlap with the internal thread. A complete overlap of the sealing lip with the region of the inner housing comprising the internal thread is realized in this respect.

The chamber may also be interlocked with the lid element and the inner housing on two planes, which with respect to the usage state of the closure device are separated from one another in the vertical direction, by forming catch projections and catch recesses on the chamber, the lid element and the inner housing, wherein the interlock with the inner housing is with respect to the vertical central axis of the closure device offset radially inward relative to the interlock with the lid element, and wherein the catch projections and catch recesses of the planes extend without overlapping one another in a projection into a common plane transverse to the vertical axis.

An improvement, particularly in terms of emptying the chamber in the course of a removal of the lid element, is also achieved due to this interlock of the chamber with the inner housing and the lid element. In comparison with the interlock of the chamber with the lid element, the interlock of the chamber with the inner housing is with respect to the central axis achieved on a significantly smaller transverse dimension, optionally on a significantly smaller diameter.

In this case, the interlocking regions can be arranged with such different transverse dimensions from the central axis or, in a rotationally symmetric design of the closure device, on such different diameters that the catch projections and the catch recesses do not overlap one another in a projection of the interlocks, particularly the catch projections and the catch recesses of the interlocks, into a common plane extending transverse to the central axis.

Furthermore, the interlocks may with respect to the central axis be spaced apart from the central axis by such different dimensions that a distance between the interlocking regions is also formed in a projection into a common plane.

In a rotationally symmetric design of the closure device, in which the central axis simultaneously forms a rotational axis, for example, the interlock between the chamber and the inner housing may according to a potential embodiment be provided on a diametric circle, the diametric dimension of which may correspond to 0.3-times to 0.7-times, e.g. to approximately 0.45-times to 0.55-times, the diametric dimension of the interlock between the chamber and the lid element.

Viewed in the radial direction to the central axis, the relevant diameter line in the plane preferably extends centrally between a radially inner or outer groove bottom of a catch recess and a radially outer or radially inner end of a catch projection interacting with this catch recess.

In addition, an advantageous manufacture, particularly an advantageous interlock in the course of the assembly of the closure device, can be achieved due to the preferred arrangement and design of the interlocks on significantly different diameters.

According to another potential embodiment, the catch projections may be formed on the vertically lower part during the normal use of the closure device. For example, this may concern a rigid plastic part that furthermore may be manufactured, e.g., in a plastic injection moulding process.

Furthermore, both parts of the chamber may consist of a rigid plastic. Both parts may also consist of the same rigid plastic or be manufactured of essentially the same rigid plastic. In this respect, polypropylene (PP), polyethylene (PE) or also polyethylene terephthalate (PET) may be used as rigid plastic material.

Both parts may also contain polybutylene terephthalate (PBT).

The supplementary section can be designed annularly and preferably enclose the parts over the entire circumference with respect to the central axis of the closure device, wherein this annular enclosure preferably can be realized in a region assigned to the partition plane only.

With respect to a vertical section, in which the vertical central axis is illustrated in the form of a line, the supplementary section may in a potential embodiment be designed with a rear engagement with the assigned sections of both parts. A positive connection between the supplementary section and one or the other part, preferably both parts of the chamber, can thereby be optionally realized in addition to a welded joint.

Such an optional additional positive connection particularly proves advantageous in a filled closure device, in which the stored medium preferably is accommodated in the chamber with overpressure.

Furthermore, the supplementary section may also have an essentially triangular or trapezoidal design with respect to the vertical section. In a triangular design, the supplementary section can be inserted into the partition plane between the facing sections of the two parts in a wedge-like manner and preferably welded to both parts.

In an exemplary trapezoidal design of the supplementary section, for example, dovetail-shaped rear engagements with the fastening regions of both parts of the chamber may be produced.

The rear engagements preferably can be advantageously achieved by overmoulding with the supplementary section material.

Furthermore, the supplementary section may clamp together the two parts in the radial direction with respect to the central axis or vertical axis. Alternatively or additionally to this radial clamping, the two parts may also be clamped together in the vertical direction by designing a rear engagement acting in the vertical direction accordingly.

With respect to the disclosure, the ranges or value ranges or multiple ranges indicated above and below also include all intermediate values, particularly in 1/10 increments of the respective dimension, but optionally also dimensionless. For example, the indication 0.3-times to 0.7-times also includes the disclosure of 0.31-times to 0.7-times, 0.3-times to 0.69-times, 0.31-times to 0.69-times, etc. The respective disclosure may on the one hand serve for defining a lower and/or upper limit of a cited range, but alternatively or additionally also for disclosing one or more singular values from a respectively indicated range.

BRIEF DESCRIPTION OF THE DRAWINGS

The invention is described in greater detail below with reference to the attached drawings that, however, merely show exemplary embodiments. A component, which is described with reference to one of the exemplary embodiments and not replaced with a different component in another exemplary embodiment, is therefore also described as a potentially existing component in this other exemplary embodiment. In the respective drawings.

DESCRIPTION OF THE EMBODIMENTS

Figure 1:
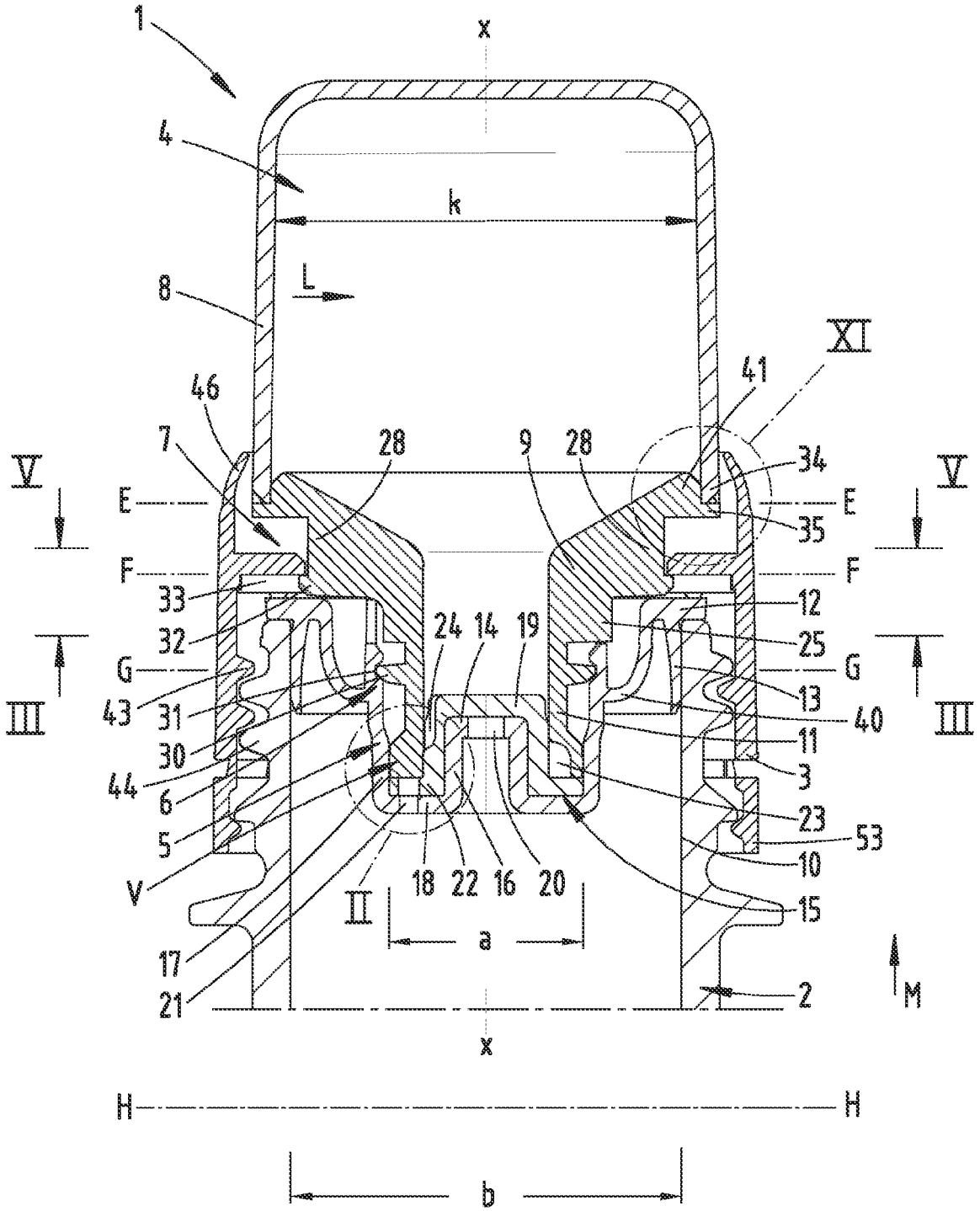
FIG. 1 shows the closure device arranged on a container in the form of a longitudinal section concerning the closed position.

A closure device 1 for a container 2 is initially described with reference to FIG. 1, wherein the closure device 1 essentially comprises a lid element 3, a chamber 4 and an inner housing 5, and wherein the chamber 4 is catch-connected to the inner housing 5 by means of a (first) interlock. The chamber preferably is composed of two parts 8, 9, wherein said parts 8, 9 are connected to one another in that a partition plane E extending perpendicular to a vertical axis x.

FIG. 1 furthermore shows an upper partial region of the container 2, which in this example is a beverage bottle, on the container opening 10 of which the closure device 1 is arranged.

The closure device 1 is located relative to the container 2 in a position, in which it closes the container opening 10 in a fluid-tight manner, wherein the closure device 1 is conventionally screwed on the container 2 such that the container opening 10 is closed.

The container 2 can be stored in this state for a prolonged period of time, during which the contents are prevented from escaping from the container 2. In order to open the container 2, the closure device 1 is conventionally unscrewed from the container 2 such that the container opening 10 ultimately is completely exposed.

The closure device 1 has a chamber 4 for the separate storage, e.g., of liquid or powdery mediums that should only be released into the contents of the container 2 at the moment, at which the closure device 1 is removed from the container 2.

The chamber 4 preferably can essentially consist of two parts 8, 9 as shown. In this case, both parts 8, 9 may be manufactured of the same material, particularly of the same rigid plastic such as PE, PET or PP, wherein both parts may according to a potential embodiment also be made entirely of PBT or partially of PBT, respectively.

In this case, the upper part 8 with respect to the normal usage position of the closure device 1, in which the axis x essentially extends vertically, furthermore may be manufactured in a plastic injection blow moulding process or alternatively in a plastic injection moulding process.

The corresponding lower part 9 of the chamber 4 preferably can be manufactured in an injection moulding process.

Furthermore, the upper part 8 may in this case have a pot-shaped design, wherein an overhead arrangement is realized with respect to the pot design. A connection to the lower part 9 preferably is produced along the edge region of the upper part 8 surrounding the downwardly directed pot opening.

In this context, it is preferred to produce a permanent connection, namely a connection that cannot be separated, particularly not separated in a non-destructive manner, operationally or by the user. Furthermore, a pressure-resistant connection is also preferred in this respect, particularly when a medium is accommodated in the chamber 4 with a pressure in excess of the ambient pressure.

The lower part 9 preferably forms a central discharge nozzle 11.

According to the illustrations, the inner housing 5 may have a pot-like design with a circumferential pot wall and a collar 12 for being supported on the container edge surrounding the container opening 10.

A circumferential sealing lip 13 may be integrally formed on the underside of the inner housing collar 12. This sealing lip interacts with the container wall surrounding the container opening 10 in the associated position according to FIG. 1.

A chamber bottom 14 is formed on the bottom side and transforms into a channel 15 over its entire circumference. With respect to the section shown in FIG. 1, this channel 15 is delimited by a radially inner channel sidewall 16 and a radially outer channel sidewall 17, as well as by a channel bottom 18.

The radially inner sidewall 16 transforms into the channel bottom 18 on its lower end and into the chamber bottom 14, which is axially spaced apart from the channel bottom 18, on its upper end. The chamber bottom 14 may essentially extend transverse to the vertical axis x as shown and optionally in parallel alignment with the channel bottom 18.

The radially outer channel sidewall 17 essentially may form the housing wall of the inner housing 5.

The surface of the channel bottom 18, in particular, but preferably also the surface of the radially inner channel sidewall 16 facing the channel space and optionally also the surface of the chamber bottom 14 facing the chamber 4, preferably can be covered with a soft plastic layer 19 as shown. This soft plastic layer preferably can be manufactured together with the inner housing 5 in a two-component injection moulding process. Alternatively, the soft plastic layer 19 can be manufactured separately in the form of a pot-like part and fixed, for example, on the inner side of the inner housing 5 by means of a catch connection.

Figure 25:
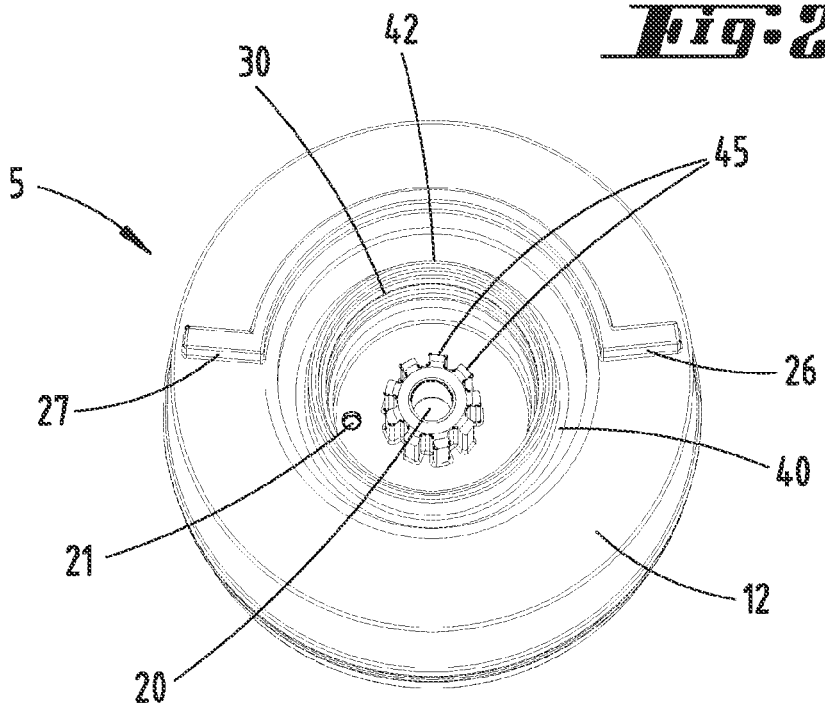
FIG. 25 shows a representation essentially corresponding to FIG. 24, but with omission of a sealing element.

According to the embodiment illustrated in FIG. 25, ribs 45 that are directed vertically outward and extend in the axial direction may be integrally formed on the channel sidewall 16 over its circumference, wherein said ribs (additionally) produce a positive connection between the inner housing 5 and the soft plastic layer 19 in the circumferential direction.

Figure 2:
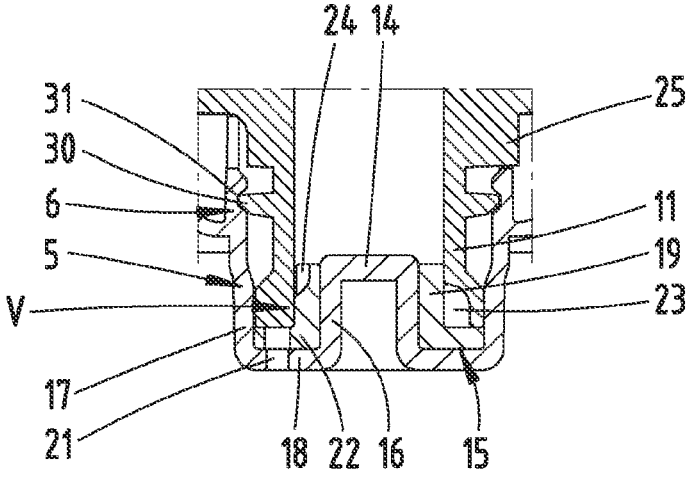
FIG. 2 shows a detailed view of a chamber bottom region concerning an alternative embodiment.
Figure 3:
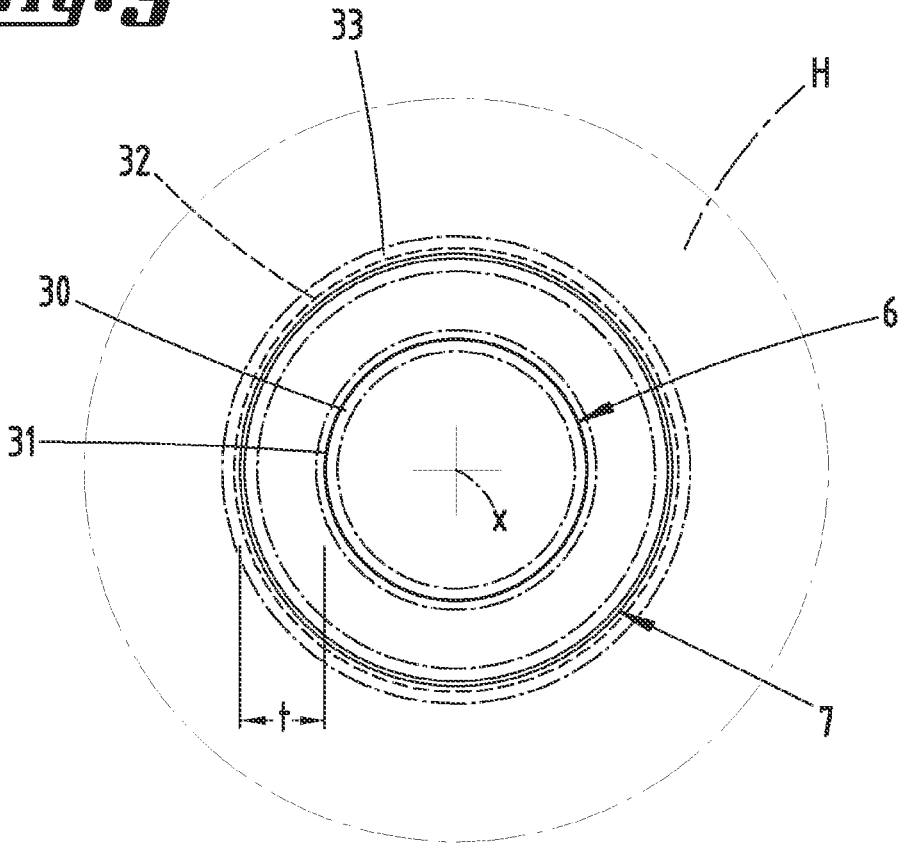
FIG. 3 schematically shows a projection of two interlocks into a common plane.
Figure 4:
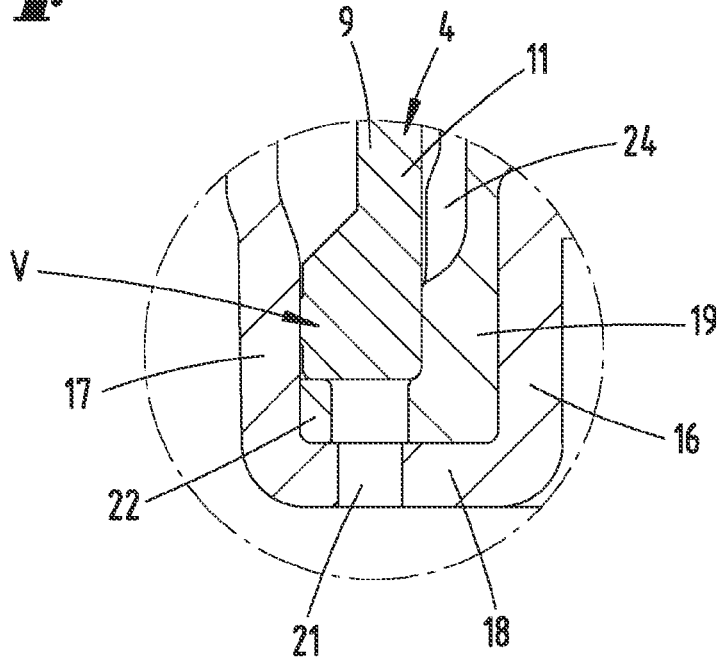
FIG. 4 shows an enlarged detail of the region IV in FIG. 1.

FIG. 2 shows an alternative embodiment, in which the chamber bottom 14 is not covered with the soft plastic layer 19. The latter extends in the region of the channel 15 only and essentially forms a lining of said channel.

For example, a thermoplastic elastomer (TPE) may be used for manufacturing the soft plastic layer 19.

The illustration in FIG. 1, in particular, furthermore shows that the chamber bottom 14 may have a central opening, which is covered by the soft plastic layer 19 in the direction of the chamber interior and by means of which the proper filling—particularly pressurized filling—of the chamber 4 can be checked prior to an attachment of the closure device 1 to the container 2.

Furthermore, a discharge opening 21 extending through the channel bottom 18, as well as through the section of the soft plastic layer 19 covering the channel bottom 18, is provided on the bottom side of the channel 15. Viewed in a plane extending transverse to the vertical axis x, this discharge opening preferably can have an outer opening edge, which circumferentially extends in the form of a circular ring and optionally has a diameter may correspond to the radial width of the channel 15 between the radially inner channel sidewall 16 and the radially outer channel sidewall 17. It is furthermore preferred that the channel 15 has only one such discharge opening 21.

The soft plastic layer 19 forms a sealing element 22 for interacting with a closing means V, which in the embodiment shown is essentially realized in a plug-like manner and particularly formed by the wall of the discharge nozzle 11.

The discharge nozzle 11 essentially extends in the form of a circular cylinder, wherein the free annular end, which in the usage state is usually directed downward, forms the closing means V and penetrates into the channel 15 of the inner housing 5.

The closing means V, in this case the annular end region of the discharge nozzle 11, is permanently seated in the sealing element 22, in this case the channel 15, and preferably is not displaced relative thereto in the direction of the vertical axis x. It is preferred that the displacement of the closing means V relative to the sealing element 22, particularly the soft plastic layer 19, takes place in the circumferential direction only, e.g. in a stop-limited manner over an angle of approximately 180 degrees.

In this case, the closing means may have a dispensing formation 23, e.g. in the form of a groove that is open-edged radially inward in the direction of the radially inner channel sidewall 16 and axially downward in the direction of the discharge opening 21. In the closed position according to the illustrations in FIGS. 1, 4, 18 and 20, this groove may be offset relative to a dispensing recess 24, which is formed in the region of the inner channel sidewall 16 in the direction of the channel 15, by approximately 180 degrees. This dispensing recess accordingly is formed in the region of the soft plastic layer 19.

This dispensing recess 24 may also be realized in the form of a groove, particularly in the form of a groove extending in the axial direction. According to the exemplary embodiments shown, this dispensing recess 24 furthermore may be provided in the transition from the inner channel sidewall 16 into the chamber bottom 14 and axially spaced apart from the discharge opening 21.

A partial radial widening of the channel 15 accordingly is formed in the region of the dispensing recess 24.

Figure 6:
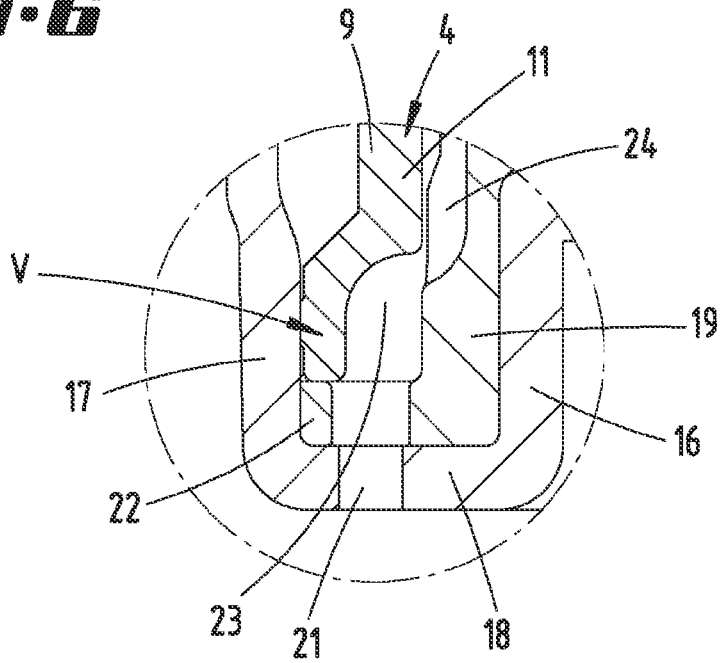
FIG. 6 shows a representation corresponding to FIG. 4, but concerning the discharge position.

As a result of a rotary displacement, the plug-shaped closing means V seated in the channel 15 is rotated into the discharge position, e.g. according to FIG. 6, in which the dispensing formation 23 and the dispensing recess 24 are moved into a corresponding alignment. This results in an overlap of the groove-like dispensing formations in the axial direction, as well as an assignment of the dispensing formation 23 to the discharge opening 21, such that the dispensing formations form the flow path for dispensing the medium located in the chamber 4 into the container interior through the discharge opening 21.

The illustration in FIG. 6 furthermore shows that an alternate discharge course of the medium stored in the chamber 4 may be formed in the direction of the vertical axis x in this discharge position. It is furthermore preferred that a course change from radially inside to radially outside occurs in this case as shown such that an advantageous and optionally delayed discharge of the medium into the container can be achieved.

Figure 5:
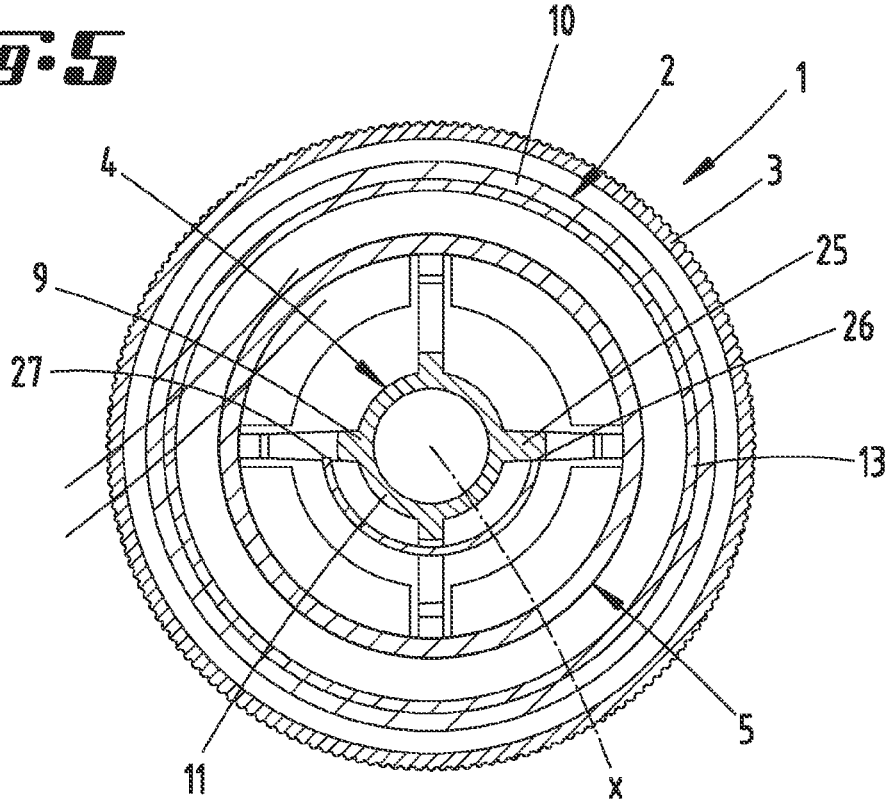
FIG. 5 shows a section along the line V-V in FIG. 1.

The rotation of the chamber 4 provided with the closing means V relative to the inner housing preferably is stop-limited. To this end, it would be possible, for example, to integrally form a radial projection 24 on the chamber 4, e.g. radially outside on the discharge nozzle 11, wherein said radial projection can interact with correspondingly positioned stops 26 and 27 of the inner housing 5 (compare to FIG. 5 and FIG. 25).

A rotation of the chamber 4 or the lid element 3, which in the embodiments according to FIGS. 1 to 16 is connected to the chamber 4 in a rotationally fixed manner, beyond the stop-limited open position for discharging the medium stored in the chamber 4 into the container interior conventionally causes the closure device 1 to be entirely unscrewed from the container 2 such that the container opening 10 is completely exposed.

Figure 7:
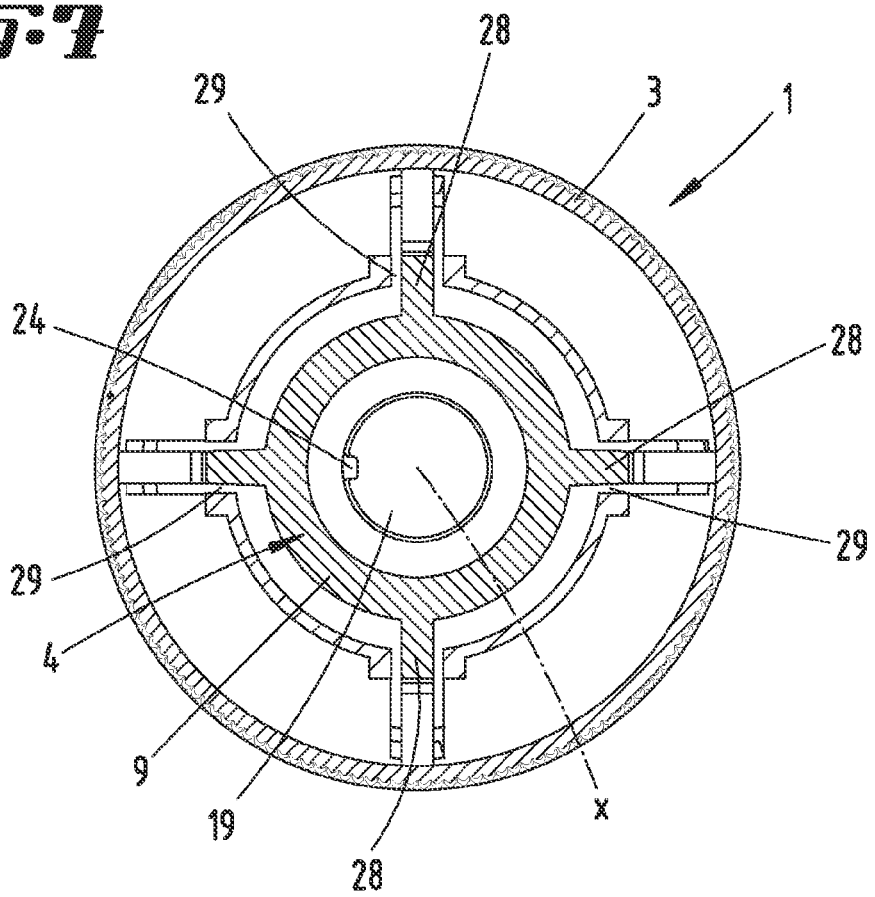
FIG. 7 shows a section along the line VII-VII in FIG. 1.

The rotationally fixed connection between the chamber 4 and the lid element 3 may be realized due to the engagement of driving ribs 28, which are integrally formed on the outer side of the chamber 4, particularly on the lower part 9, and protrude radially outward into corresponding driving receptacles 29 of the lid element 3 in a wing-like manner (compare particularly to FIG. 7).

The driving ribs 28 and preferably also the above-described radial projection 25 can be realized integrally and uniformly in material with the lower part 9 of the chamber 4 and preferably manufactured in a plastic injection moulding process.

Furthermore, the lower part 9 may have a preferably annular catch projection 30 that extends circumferentially with respect to the vertical axis x, wherein said catch projection is viewed in the axial direction arranged between the end region that essentially forms the closing means V and the region provided with the radial projection 25. This catch projection 30 engages into a flute-like catch recess 31 arranged on the inner side of the circumferential inner housing wall in order to form the (first) interlock 6.

In addition to the thusly formed (first) interlock 6, a rotary support for the chamber 4, particularly its lower part 9, on the inner housing 5 can thereby also be achieved.

The interlock 6 preferably can be offset radially inward in an offset direction L relative to a greatest width k of the chamber 4, which is measured in a vertical direction M resulting from the alignment of the vertical axis x and according to the embodiments shown is formed in the region of the part 8. An extending dimension in the region of the interlock 6, which is likewise measured transverse to the vertical direction M, may correspond to approximately 0.4-times to 0.8-times, furthermore to approximately 0.5-times to 0.6-times, the above-described width k of the chamber 4.

According to the embodiments illustrated in FIGS. 18 to 25, the chamber 4 essentially may comprise this one interlock 6 between the chamber 4 and the inner housing 5 only. In this case, this interlock 6 preferably can be separated from a shoulder section 40 of the inner housing 5 formed on the bottom side underneath the interlock 6 in the vertical direction M (compare to FIGS. 18 and 25).

This shoulder section 40 is connected to the region of the upper end of the circumferential pot-like channel sidewall 17 on the outer side and extends along an upward arc as far as into the collar 12, which essentially extends transverse to the vertical axis x, with approximately parallel spacing from the sealing lip 13.

A free-standing cylinder section 42 extends vertically upward beyond the root region of the shoulder section 12 on the channel sidewall 17, wherein the catch recess 31, e.g. in the form of a circumferential groove, is formed on the wall of said cylinder section that is directed radially inward.

The cylinder section 42 ends—viewed from the channel bottom 18—at a distance from the plane defined by the collar 12.

During a rotation of the chamber 4 relative to the inner housing 5 in order to release the discharge opening 21, a circumferential friction surface accordingly may be formed between the lower part 9 of the chamber 4 and the inner housing 5, particularly in the interacting region between the catch projection 30 and the catch recess 31, but optionally also between the free end of the discharge nozzle 11 forming the closing means V and, in particular, the radially outer channel sidewalls 17. These friction surfaces extend at least approximately in the region of identical diametric dimensions a, wherein said diametric dimension a may correspond to approximately 0.4-times to 0.6-times the clear inside diameter b in the region of the container opening 10.

The inner housing 5 also may be retained on the container 2 in the region of the container opening 10 in a frictionally engaged manner only, particularly as a result of the contact of the sealing lip 13 with the facing inner side in the region of the container opening 10 (compare to FIG. 1). As a result of the above-described arrangement and design of the discharge nozzle 11, as well as of the first interlock 6 between the inner housing 5 and in the chamber 4, an advantageous relation in terms of the frictional forces can be achieved such that the frictional force between the inner housing 5 and the container 2 is not or not significantly influenced, in particular, by an initial 180 degree rotation of the chamber 4 along with the lid element 3 into the release position of the discharge opening 21.

The friction surface between the inner housing 5 in the region of its sealing lip 13 and the inner wall of the container 2 in the region of the container opening 10 preferably extends on the above-described diameter b, on which the second interlock 7 between the chamber 4 and the lid element 3 essentially may also extend.

Figure 8:
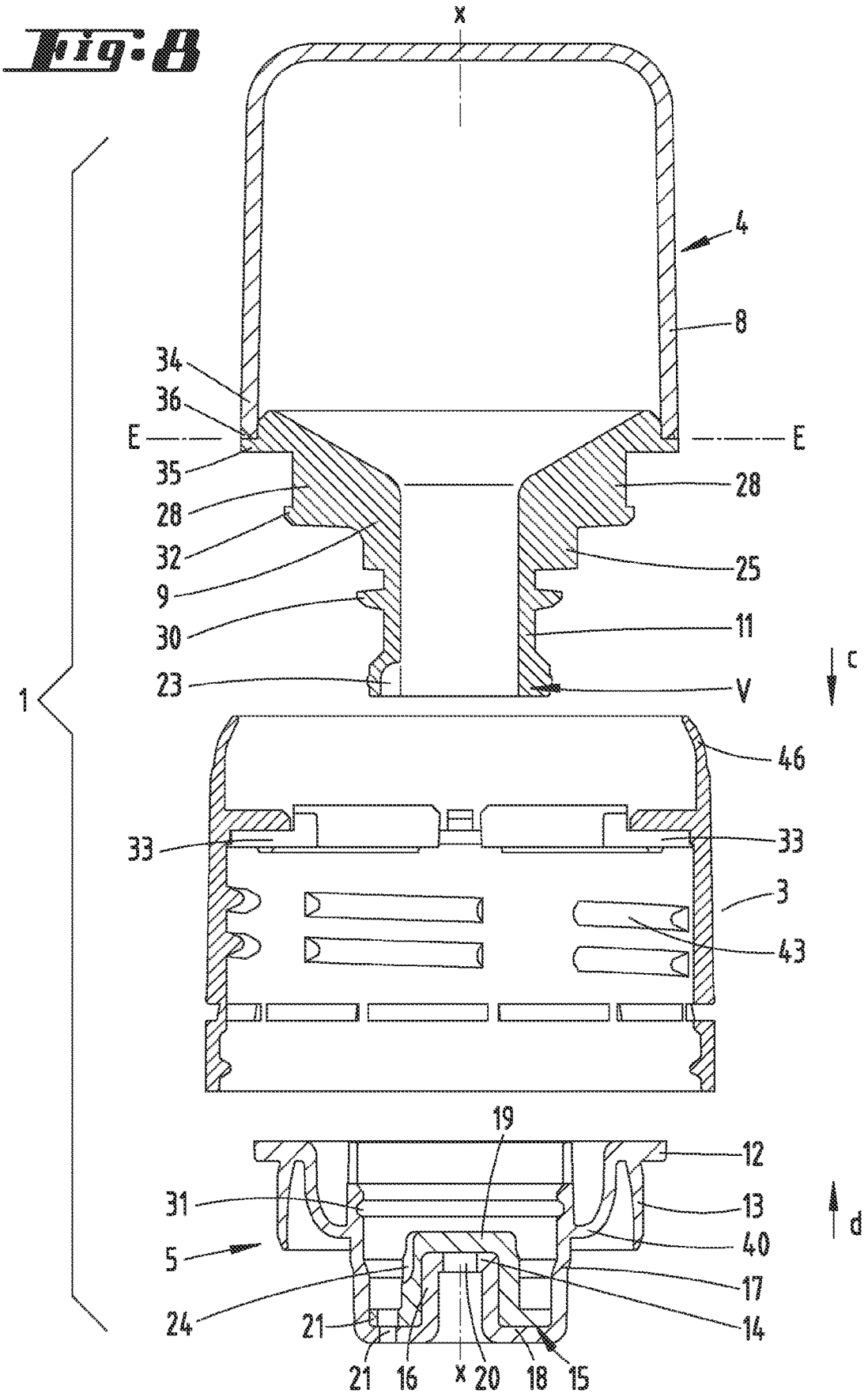
FIG. 8 shows the closure device in the form of a longitudinal section concerning an exploded view of a tank, a lid element and an inner housing of the closure device.
Figure 9:
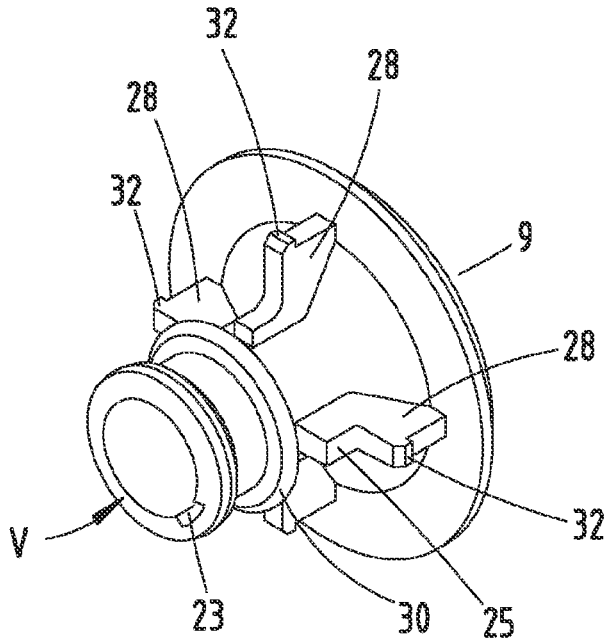
FIG. 9 shows the inner housing in the form of an individual perspective view.
Figure 10:
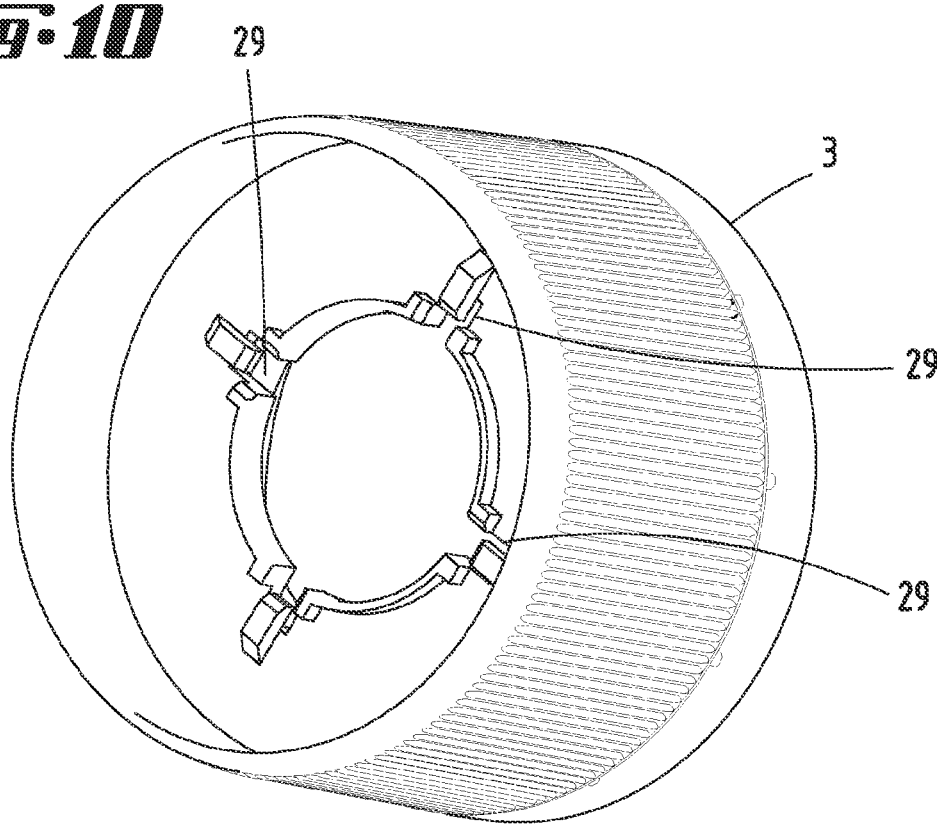
FIG. 10 shows the lid element in the form of an individual perspective view.

In the embodiments illustrated in FIGS. 1 to 16, a second interlock 7 between the inner housing 5 and the lid element 3 may be provided in addition to the first interlock 6. This second interlock 7 can be achieved by forming an additional catch projection 32 on the chamber 4, particularly on the lower part 9. This catch projection 32 may be realized in the form of a radial projection in the region of the driving ribs 28 as shown in FIG. 9.

In this case, the lid element may be provided with a catch recess 33 on the underside of the driving receptacles 29 for the driving ribs 28. This catch recess 33 of the illustrated embodiment may be exposed vertically downward as shown.

The catch projection 32, as well as the catch recess 33, preferably can be designed circumferentially concentric to the axis x.

The section in FIG. 1, in particular, furthermore shows that the pairs of catch projections 30 and 32 and catch recesses 31 and 33 extend at different radial distances from the vertical axis x, wherein the catch projection 32 and the catch recess 33 of the upper, second interlock 7 have a greater radial spacing than the catch element pair of the first interlock 6.

The catch projections 30 and 32 and the catch recesses 31 and 33 do not overlap in a potential projection of the catch element pairs of the first and second interlocks 6, 7 into a common plane extending transverse to the vertical axis x. In fact, they are spaced apart from one another in the radial direction.

A line extending centrally through the respective interlock 1 or 2 and concentric to the vertical axis x has in the region of the first interlock 6 a diameter, which may correspond to approximately 0.4-times to 0.6-times the equivalent circular line in the region of the second interlock 7.

An advantageous assembly can be achieved as a result of the interlock described with reference to the first exemplary embodiment. This is schematically illustrated in FIG. 8. The parts 8 and 9 assembled into the chamber 4 can be inserted into the lid element 3 from above with respect to a normal usage position and interlocked with this lid element (see arrow c) whereas the inner housing 5 is inserted into the lid element 3 in the opposite direction from below and connected to the chamber 4 in the region of the first interlock 6 (see arrow d).

The closure device 1 can be filled in this assembled position.

The interlocks 6 and 7 evidently are formed in the region of different planes F and G that are spaced apart from one another in the axial direction, namely in such a way that the interlocks 6 and 7 do not overlap in a projection of the interlocks 6 and 7 into a common plane H extending transverse to the axis x. In fact, the radially outer interlock 7 and the radially inner interlock 6 spaced apart from one another by a distance t (see FIG. 3).

FIGS. 11 to 17 show different embodiments for connecting the two parts 8 and 9 in order to form the chamber 4.

It is preferred to respectively provide a welded joint. This welded joint basically can be produced, for example, by means of ultrasonic welding, optionally by directly connecting the two parts 8 and 9 in the region of a free outer front edge 34 of the upper part 9 and an assigned pedestal region 35 of the lower part 9.

Figure 11:
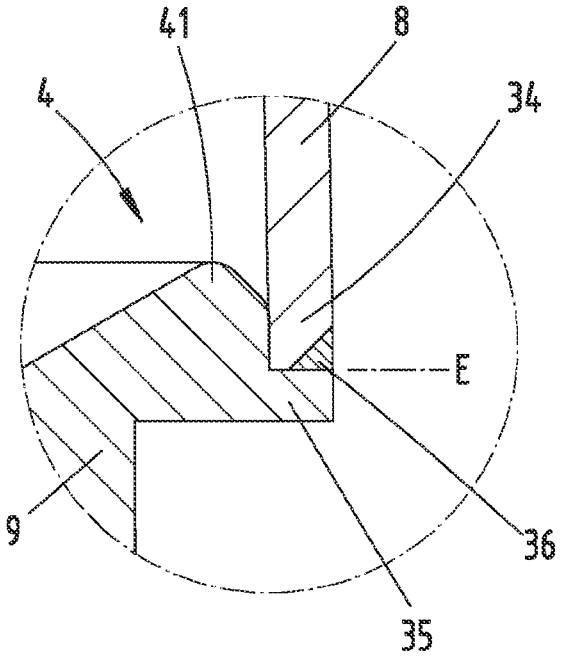
FIG. 11 shows an enlarged detail of the region XI in FIG. 1.

According to the embodiment in FIG. 11, a cross-sectionally outer circumferential wedge surface may be cut into the edge region 34 of the upper part 8 in order to accommodate a supplementary section 36 produced by overmoulding the region. In this case, the supplementary section 36 preferably is manufactured of the same plastic material as the two parts 8 and 9. A fusion or welded joint respectively is achieved in the region of the contact surfaces in the course of the respective manufacture or overmoulding with the supplementary section material.

The supplementary section 36 may in a broader sense form a connecting welding seam, wherein the supplementary section 36 as a whole may be designed in an annular manner.

In alternative embodiments, the supplementary section may be designed with a rear engagement, particularly a rear engagement 37 acting in the radial direction, with respect to a vertical section as shown.

Figure 12:
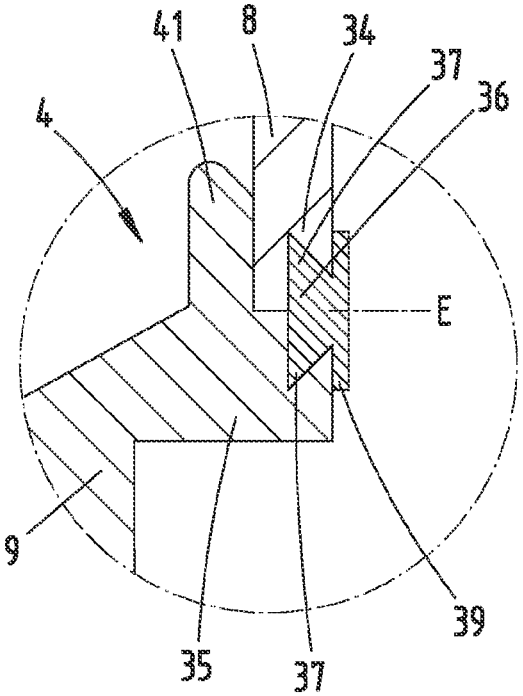
FIGS. 12-16 respectively show representations essentially corresponding to FIG. 11, but concerning other embodiments.
Figure 13:
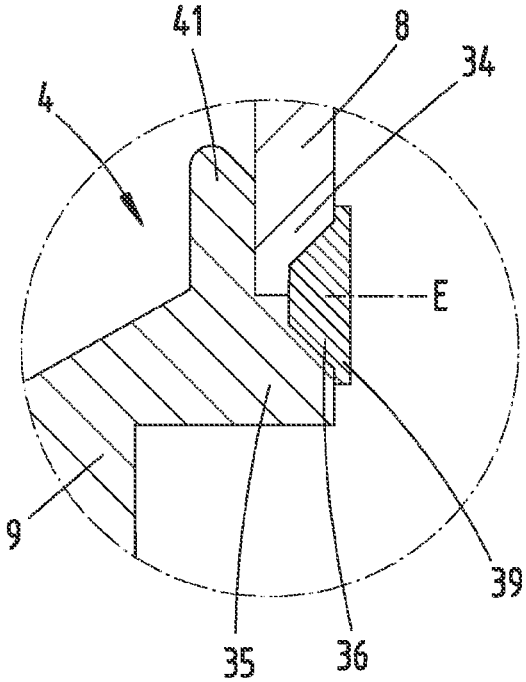

According to the illustration in FIG. 12, this can be achieved, for example, with a cross-sectionally trapezoidal design of the supplementary section 36, wherein an approximately dovetail-shaped wedge connection can thereby also be produced. Accordingly, a positive connection—which in this case acts in the radial direction—preferably is also produced in addition to a welded joint.

Figure 14:
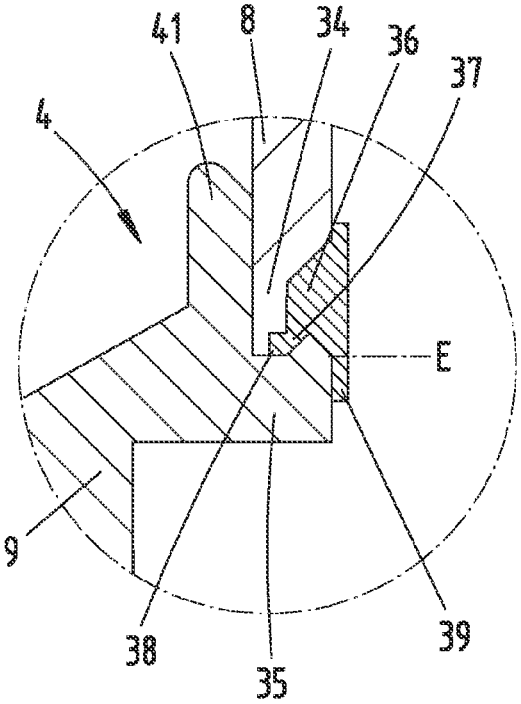

The rear engagement 37 may be realized with respect to one of the parts 8 or 9 only, e.g. with the lower part 9 as shown in FIG. 14, whereas no such rear engagement may be realized with respect to the other part (in this case the upper part 8).

Figure 15:
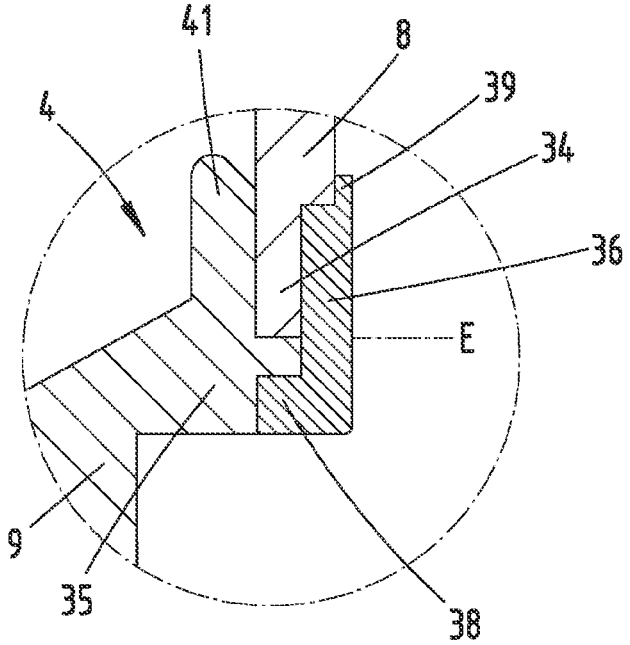
Figure 16:
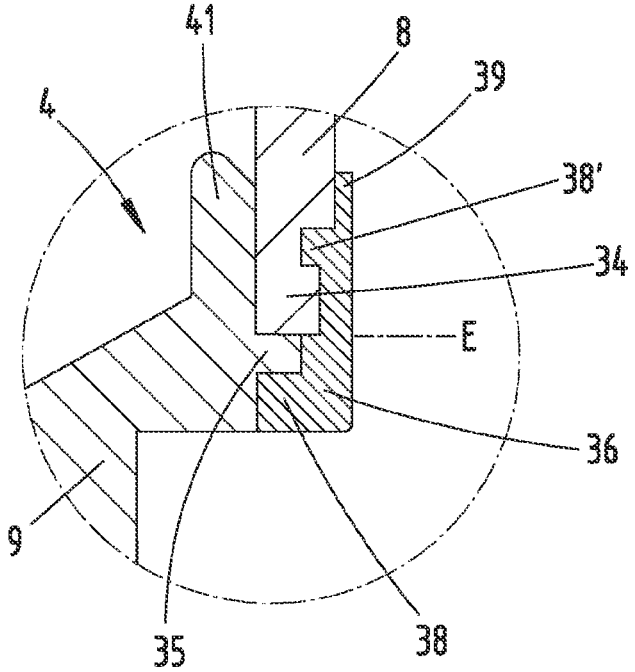

A rear engagement 38 acting in the axial direction may be provided alternatively or additionally to such a radial rear engagement 37 such that the supplementary section 36 clamps the two parts 8 and 9 together in the vertical direction (compare to FIGS. 15 and 16).

In this case, an axial rear engagement 38 may also be realized in the pedestal region 35 according to the illustration in FIG. 15. Alternatively, an additional axial rear engagement 38' may be provided in the edge region of the upper part as shown in FIG. 16 such that secure clamping can be achieved.

An axial rear engagement 38, which is formed in the edge region 34 of the upper part 8 only, can produce an advantageous connection in conjunction with a radial rear engagement 37 in the pedestal region 35 (compare to FIG. 14).

The illustrations in FIGS. 12 to 16, in particular, furthermore show that the supplementary section may with respect to the cross-sectional view be protracted radially outward and accordingly protrude beyond the facing outer edge delimitation of the upper and the lower part 8 and 9. This makes it possible to form an annular collar 39 that altogether lies on the outer wall of the chamber 4 and preferably extends circumferentially.

The welding seam formed directly by the supplementary section 36 may also be enclosed radially outside and circumferentially by a collar 46 of the lid element 4 that protrudes axially upward. The welding seam is thereby concealed.

According to the embodiment illustrated, e.g., in FIG. 1, the lid element 3 may have an internal thread 43 that interacts with an external thread 44 of the container and preferably is formed in radial overlap with the sealing lip 13. In this case, the lid element 3 enclosing the container neck serves as a handling element for opening the container 2, wherein a rotary movement of the lid element 3 initially causes the chamber 4 to be rotationally driven along relative to the inner housing 5 and, once the rotary stop is reached, subsequently also causes the inner housing 5 to be screwed out—while discharging the medium into the container 2—such that a unit consisting of the chamber 4, the inner housing 5 and the lid element 3 ultimately can be removed from the container 2.

Figure 18:
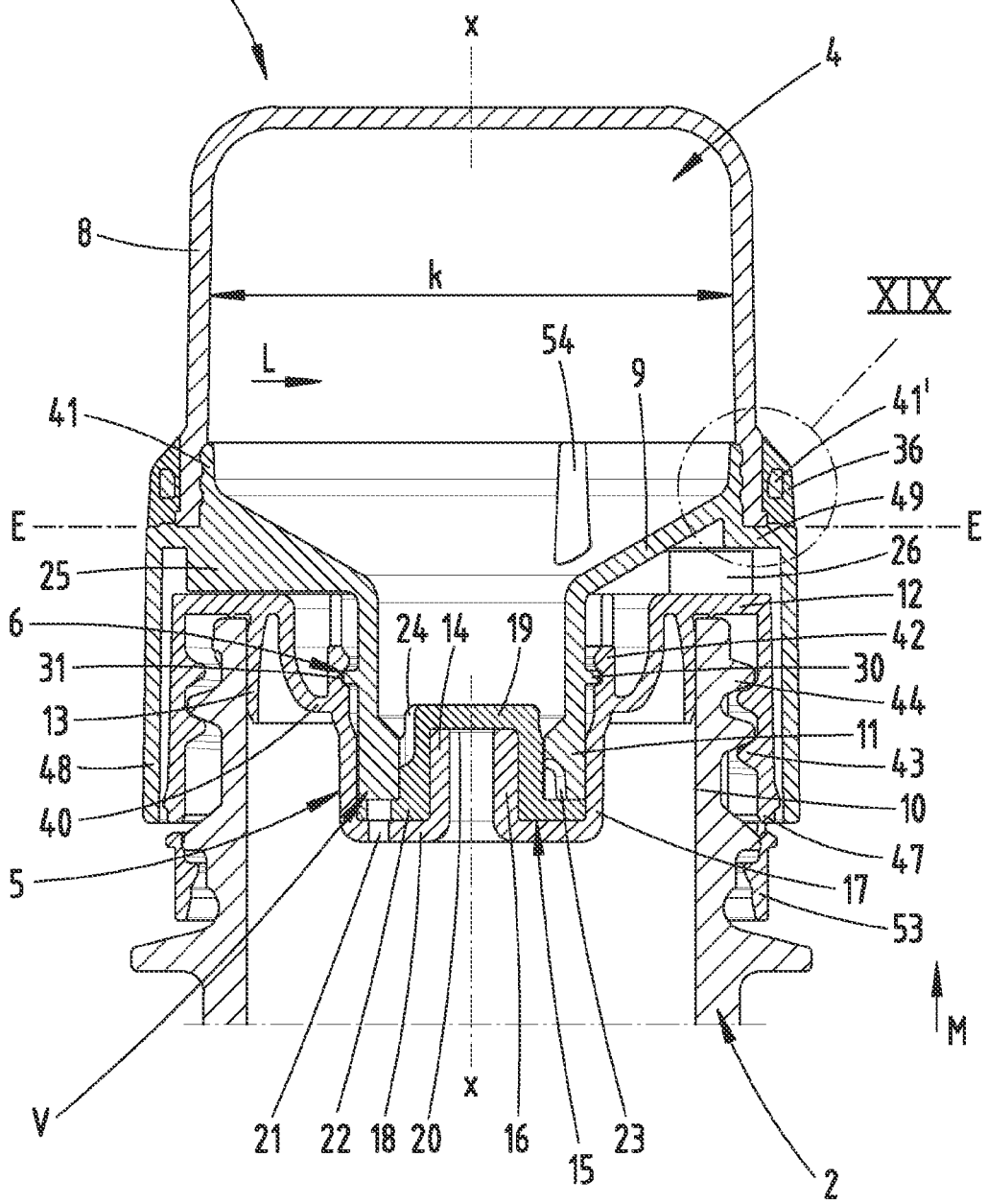
FIG. 18 shows a representation according to FIG. 1 concerning another embodiment.
Figure 20:
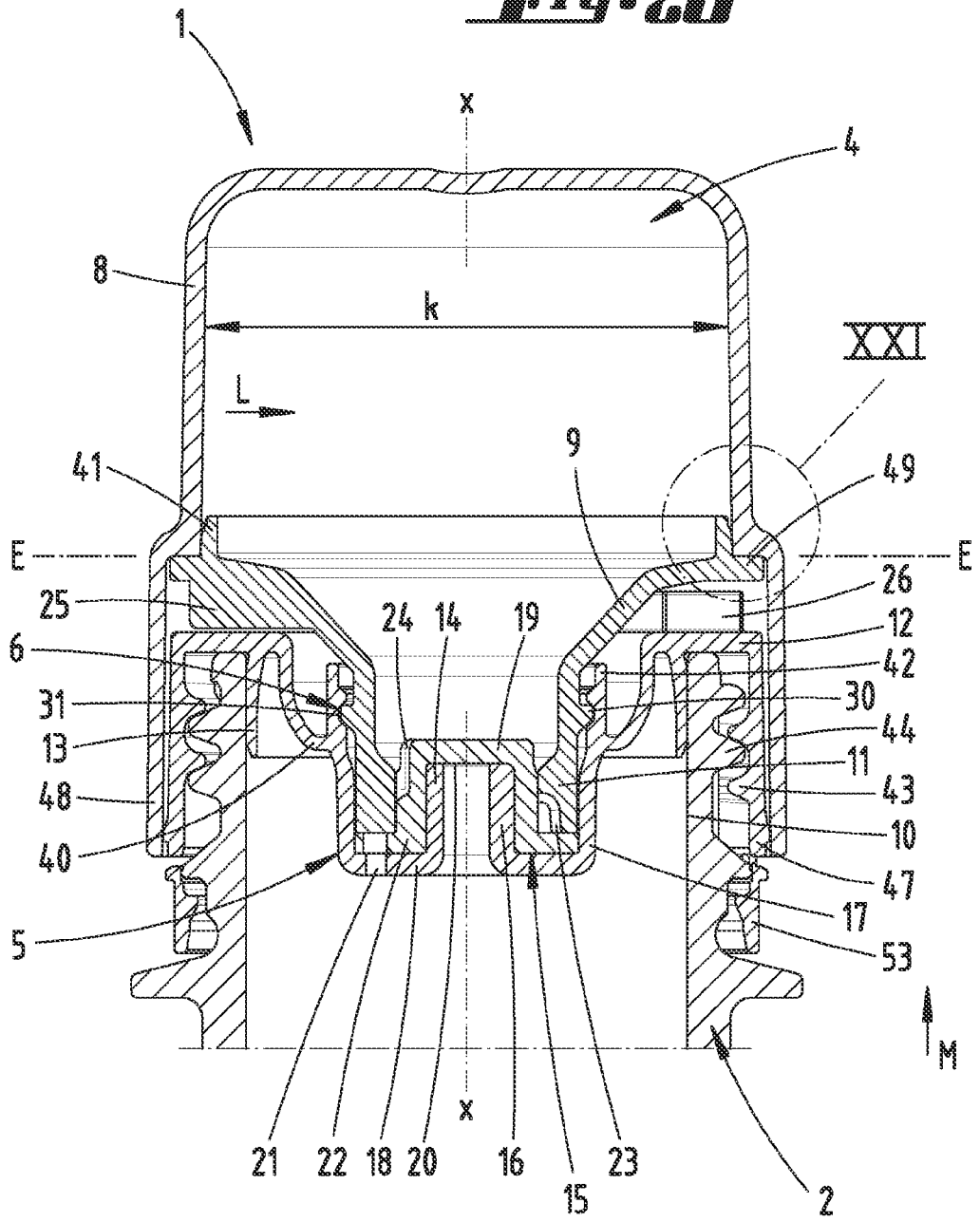
FIG. 20 shows another embodiment in the form of a representation according to FIG. 1.

The screw connection between the container 2 and the closure device 1 may be alternatively realized by means of the inner housing 5 (compare to FIGS. 18 and 20). To this end, the inner housing is provided with the internal thread 43 for interacting with the external thread 44 of the container 2 on a shell section 47, which protrudes from the radially outer end of the collar 12, extends circumferentially coaxial to the vertical axis x and is aligned in radial overlap with the sealing lip 13.

In the unused position according to FIGS. 18 and 20, this shell section 47 is enclosed—preferably in its entirety—by a cylinder shell 48 of the chamber 4. This cylinder shell 48 particularly is formed on the part 9 integrally and preferably uniformly in material. The cylinder shell 48 encloses the shell section 47 at a distance and is not driven along in any way.

The diameter of the cylinder shell 48 preferably is increased relative to the outside diameter of the chamber 4 in the region of the part 8 such that a radial step toward the outside is formed in the transition, wherein the connection of the parts 8 and 9 preferably is produced in said step region.

Figure 19:
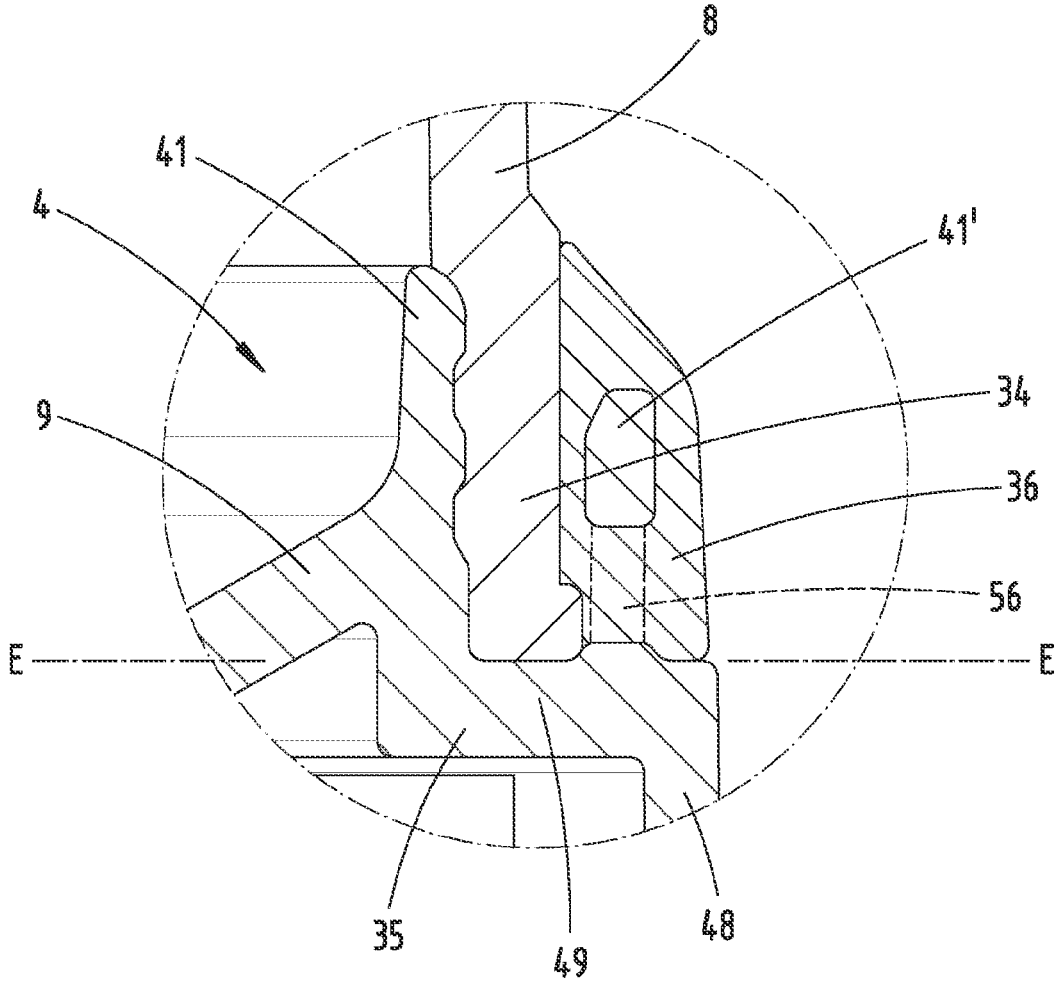
FIG. 19 shows an enlarged detail of the region XIX in FIG. 18.

In the embodiment illustrated in FIGS. 18 and 19, it is likewise possible to use a supplementary section 36 on the lower side of the part 8, which is supported on the above-described step.

According to the embodiment in FIGS. 20 to 25, the parts 8 and 9 may also be directly welded to one another, particularly by means of ultrasonic welding.

Figure 21:
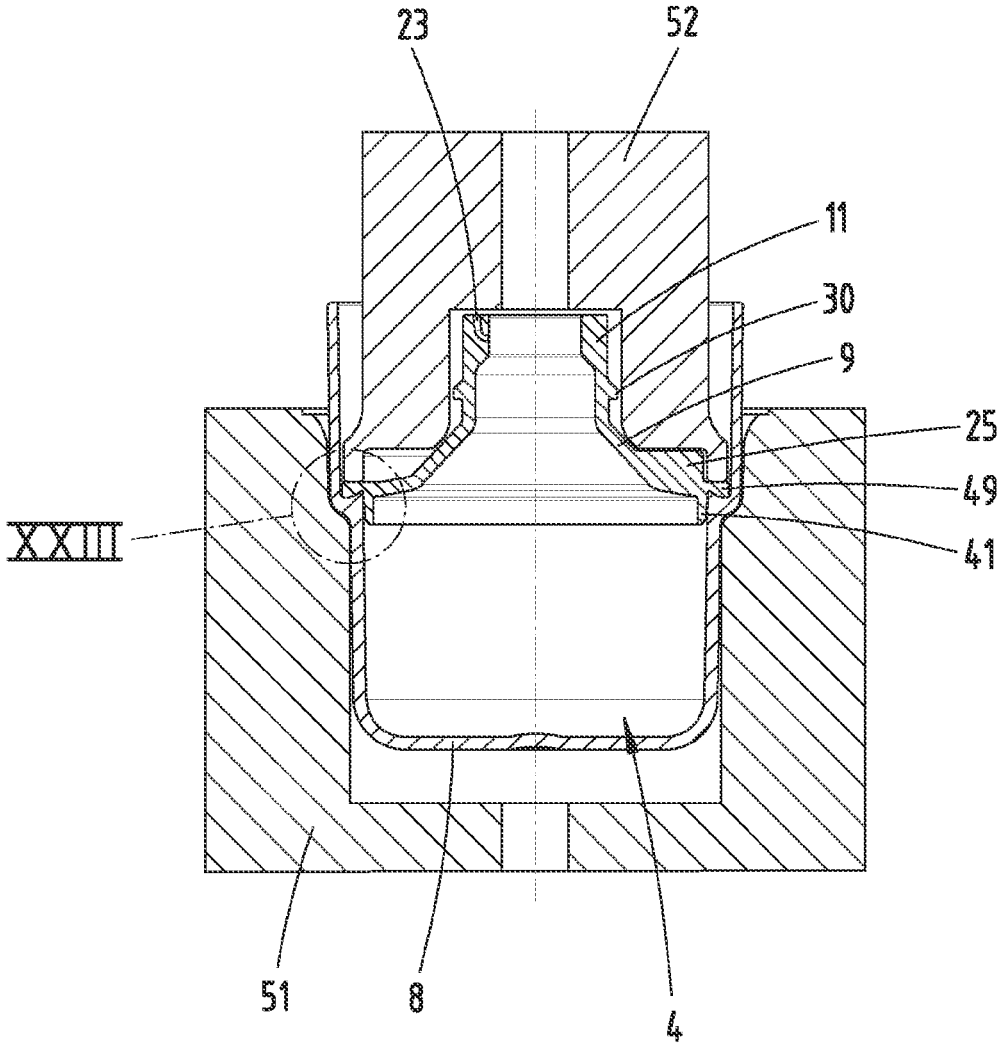
FIG. 21 schematically shows an arrangement in the course of an ultrasonic welding process of two chamber parts of the device according to FIG. 20.
Figure 22:
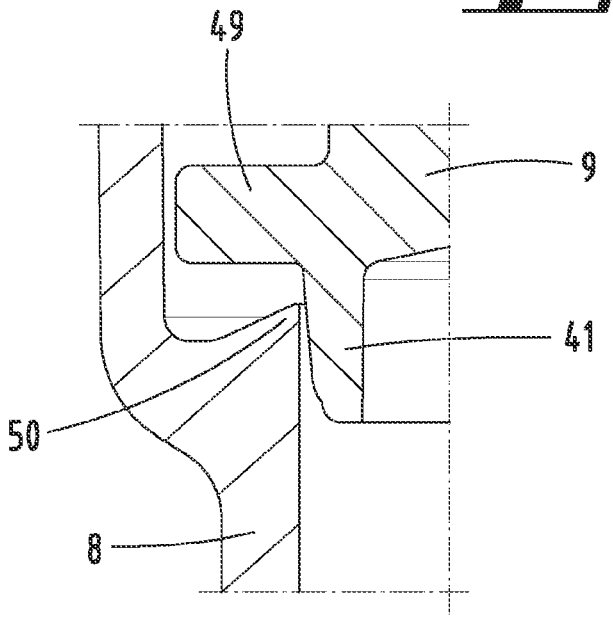
FIG. 22 shows an enlarged detail of the region XXII in FIG. 21.
Figure 23:
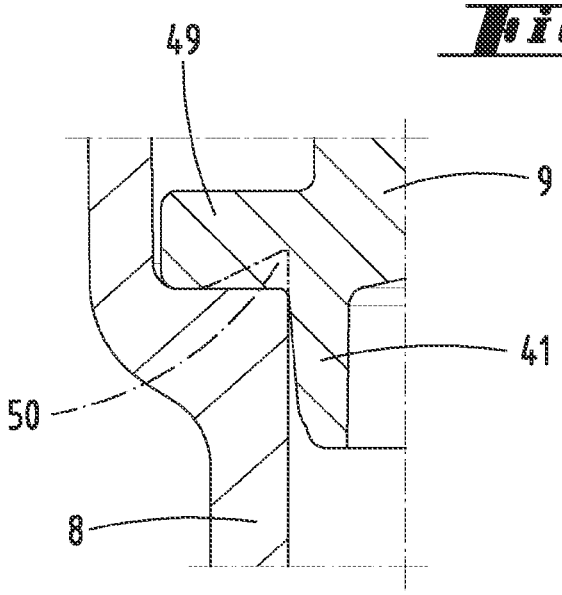
FIG. 23 shows a representation corresponding to FIG. 22, but after carrying out the ultrasonic welding process.
Figure 24:
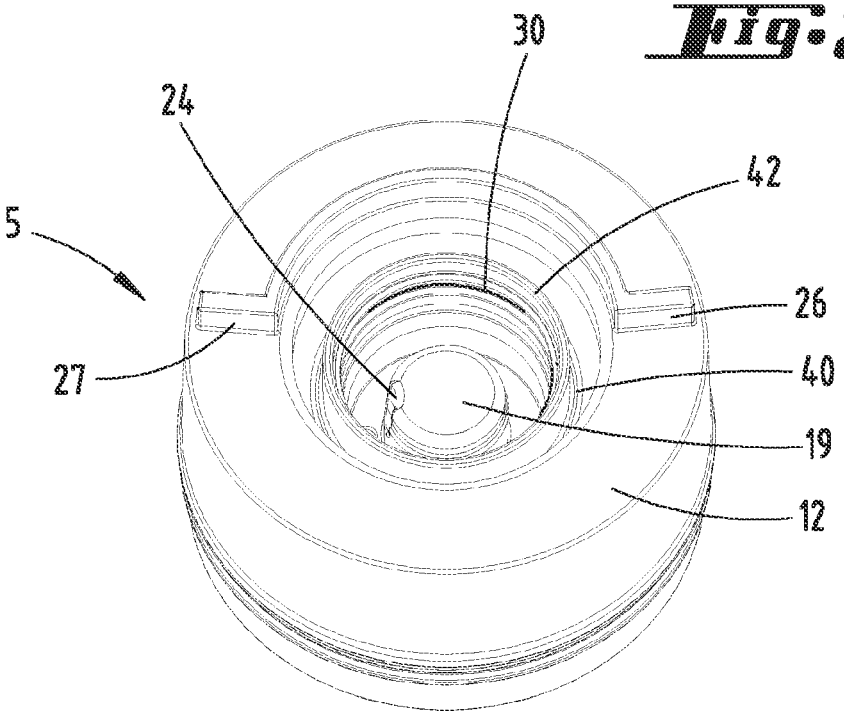
FIG. 24 shows the inner housing of the embodiment according to FIG. 21 in the form of an individual perspective view.

For example, the upper part 8 may to this end have excess material 50, which extends circumferentially and in a cross section has, e.g., a wedge-like shape, on its edge that is directed downward in the direction of a welding collar 49 formed by the pedestal region 35, wherein said excess material melts in the course of the ultrasonic welding process and serves for forming the welding seam (compare to FIGS. 21 to 23). For this process, for example, the part 8 of the chamber 4 is placed into a form-fitting anvil 51 in an overhead position, whereupon the part 9 is correspondingly positioned and the ultrasonic welding process is purposefully carried out in the region of the circumferentially provided excess material 50 by means of a sonotrode 52 (compare to FIG. 21).

The resulting direct welded joint, particularly the thusly produced welding seam, preferably is covered radially outward by an axial collar of the upper part 8 of the chamber 4, which forms the cylinder shell 48 enclosing the shell section 47 of the inner housing 5.

The partition plane E between the parts 8 and 9 of the chamber 4 preferably extends through an overlapping section 41 of the lower part 9 of the chamber 4 regardless of the type of welded joint. This overlapping section 41 preferably abuts on the facing end region of the upper part 8 radially inside and thereby provides this end region with a radial support, which is particularly advantageous in the course of the welding process. The overlapping section 41 serves for producing a plug-in connection between the parts 8 and 9.

Figure 17:
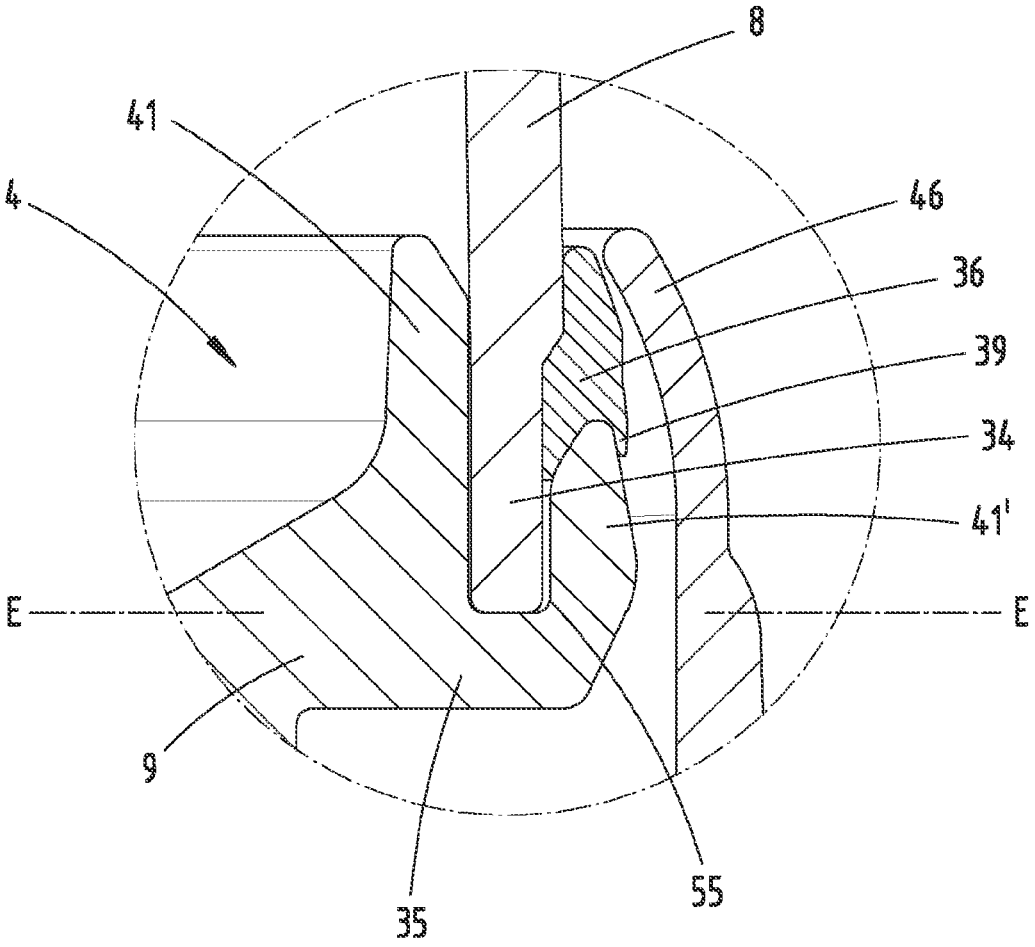
FIG. 17 shows another embodiment in the form of a detailed view corresponding to FIG. 11.

The illustration in FIG. 17, for example, shows that another overlapping section 41' may be provided in addition to the described overlapping section 41 radially outside the edge region 34 of the upper chamber part 8 such that a plug-in groove 55 for the downwardly directed edge region 34 of the part 8 is formed on the welding collar 49 of the lower chamber part 9 formed by the pedestal region 35. In this case, the partition plane E preferably can extend through the radially inner overlapping section 41, as well as the radially outer overlapping section 41'.

Such an optionally provided radially outer overlapping section 41' may contain radial through-holes 56, e.g. as illustrated in FIG. 19, such that multiple overlapping regions extending in a bridge-like manner are formed along the circumference. Material of the supplementary section 36 can penetrate through the radial through-holes 56 in the course of overmoulding the welding region between the parts 8 and 9. The welded joint is facilitated by the additionally produced positive connection.

In the embodiments illustrated in FIGS. 18 to 25, the cylinder shell 48 of the chamber 4 serves as a handling element for opening the container 2. A rotation of the chamber 4 causes this chamber to be displaced relative to the inner housing 5 into the position, in which the medium in the chamber 4 is released, whereupon the inner housing 5 is driven along in the rotating direction due to the rotary stop such that the closure device 1 as a whole is rotationally displaced relative to the container 2.

A tamper-evident ring 53 is torn off when the closure device is unscrewed from the container 2 independently of the described embodiments.

According to the example illustrated in FIG. 18, an eccentric pin 54, which essentially is aligned in the vertical direction M, also may be integrally formed in the chamber 4, for example in a funnel-like inlet of the lower part 9 in the direction of the channel 15. Such a pin can advantageously affect the outflow behavior of the medium during a discharge from the chamber 4, e.g. as a result of causing the medium to swirl.

An alternate course according to the embodiment illustrated in FIG. 6 is also realized in this case in the discharge position.

The preceding explanations serve for elucidating all inventions that are included in this application and respectively enhance the prior art independently with at least the following combinations of characteristics, wherein two, multiple or all of these combinations of characteristics may also be combined with one another, namely:

A closure device, which is characterized in that the interlock 6 is in the vertical direction M designed separately from a shoulder section 40 of the inner housing 5 formed on the bottom side underneath the interlock 6.

A closure device, which is characterized in that the two parts 8, 9 are welded to one another in the partition plane E, wherein the welded joint is produced by means of a supplementary section 36 that is connected to both parts 8, 9 and produced by overmoulding.

A closure device, which is characterized in that the two parts 8, 9 are welded to one another in the partition plane E, wherein the welded joint is outwardly covered by the upper part 8, and wherein the upper part 8 and the lower part 9 of the chamber 4 furthermore are connected by means of a plug-in connection.

A closure device, which is characterized in that the interlock 6 is formed on a free-standing cylinder section 42 of the inner housing 5.

A closure device, which is characterized in that the inner housing 5 at the same time has an internal thread for interacting with an external thread 44 of the container 2, as well as a sealing lip 13 that is spaced apart from the internal thread 43 radially inward.

A closure device, which is characterized in that the sealing lip 13 is realized in radial overlap with the internal thread 43.

A closure device, which is characterized in that the chamber 4 is interlocked with the lid element 3 and the inner housing 5 on two planes F, G, which with respect to the usage state of the closure device 1 are separated from one another in the vertical direction M, by forming catch projections 30, 32 and catch recesses 31, 33 on the chamber 4, the lid element 3 and the inner housing 5, wherein the interlock 6 with the inner housing 5 is with respect to the vertical central axis x of the closure device 1 offset radially inward relative to the interlock 7 with the lid element 3, and wherein the catch projections 30, 32 and catch recesses 31, 33 of the planes F, G extend without overlapping one another in a projection into a common plane H transverse to the vertical axis x.

A closure device, which is characterized in that the catch projections 30, 32 are formed on the vertically lower part 9.

A closure device, which is characterized in that both parts 8, 9 consist of a rigid plastic.

A closure device, which is characterized in that both parts 8, 9 contain polybutylene terephthalate.

A closure device, which is characterized in that the supplementary section 36 is designed annularly.

A closure device, which is characterized in that the supplementary section 36 is designed with a rear engagement 37, 38 with respect to a vertical section, in which the vertical central axis x is illustrated in the form of a line.

A closure device, which is characterized in that the supplementary section 36 essentially is designed triangular or trapezoidal with respect to the vertical section.

A closure device, which is characterized in that the supplementary section 36 clamps together the two parts 8, 9 in the vertical direction.

All disclosed characteristics are essential to the invention (individually, but also in combination with one another). The disclosure of the associated/attached priority documents (copy of the priority application) is hereby fully incorporated into the disclosure content of this application, namely also for the purpose of integrating characteristics of these documents into claims of the present application. The characteristics of the dependent claims also characterize independent inventive enhancements of the prior art without the characteristics of a claim to which they refer, particularly for submitting divisional applications on the basis of these claims. The invention specified in each claim may additionally comprise one or more of the characteristics that were disclosed in the preceding description and, in particular, are identified by reference symbols and/or included in the list of reference symbols. The invention also concerns design variations, in which individual characteristics cited in the preceding description are not realized, particularly as far as they are obviously dispensable for the respective intended use or can be replaced with other, identically acting technical means.

LIST OF REFERENCE SYMBOLS

1 Closure device
2 Container
3 Lid element
4 Chamber
5 Inner housing
6 Interlock
7 Interlock
8 Part
9 Part
10 Container opening
11 Discharge nozzle
12 Collar
13 Sealing lip
14 Chamber bottom
15 Channel
16 Channel sidewall
17 Channel sidewall
18 Channel bottom
19 Soft plastic layer
20 Opening
21 Discharge opening

22 Sealing element
23 Dispensing formation
24 Dispensing recess
25 Radial projection
26 Stop
27 Stop
28 Driving rib
29 Driving receptacle
30 Catch projection
31 Catch recess
32 Catch projection
33 Catch recess
34 Edge region
35 Pedestal region
36 Supplementary section
37 Rear engagement
38 Rear engagement
38' Rear engagement
39 Annular collar
40 Shoulder section
41 Overlapping section
41' Overlapping section
42 Cylinder section
43 Internal thread
44 External thread
45 Rib
46 Collar
47 Shell section
48 Cylinder shell
49 Welding collar
50 Excess material
51 Anvil
52 Sonotrode
53 Temper-evident ring
54 Pin
55 Plug-in groove
56 Radial through-hole
a Diameter
b Diameter
c Arrow
d Arrow
k Width
t Distance
x Vertical axis
E Partition plane
F Plane
G Plane
H Common plane
L Offset direction
M Vertical direction
V Closing means

The invention claimed is:

1. A closure device (1) for a container (2) with a container opening (10), comprising; a lid element (3) configured for closing the container opening (10), a chamber (4) assigned to the lid element (3) and an inner housing (5), wherein the chamber (4) and the inner housing (5) have closing and opening elements that correspond to one another and interact with one another in such a way that a medium contained in the chamber (4) can exit into the container (2) due to a movement of the lid element (3) relative to the inner housing (5), wherein the chamber (4) has a freely projecting closure edge, which in a usage state is directed into a container interior, circumferentially extends around a central axis of the chamber (4) in an annular manner and in the closed state interacts with the inner housing (5) in a closing manner, wherein the inner housing (5) forms a chamber bottom (14) that is delimited by the closure edge, wherein the chamber bottom (14) forms a channel (15) that extends around an entire circumference of the chamber bottom and which is delimited by a radially inner channel side wall (16), a radially outer channel side wall (17) and a channel bottom (18), wherein the chamber (4) forms a discharge nozzle (11) having an annular end region that is permanently seated in a sealing element (22) disposed in the channel (15) so as to be not displaceable in a vertical direction (x), wherein the chamber (4) is interlocked with the inner housing (5), and wherein the interlock (6) with the inner housing (5) is with respect to a vertical central axis (x) of the closure device (1) offset radially inward in relation to a greatest inner width (k) of the chamber (4) in an offset direction (L), wherein the interlock (6) is in the vertical direction (M) designed separately from a shoulder section (40) of the inner housing (5), which is formed on the bottom side underneath the interlock (6) and functionally connected to the container opening (10).

2. A closure device (1) for a container (2) with a container opening (10), comprising: a lid element (3) for closing the container opening (10), a chamber (4) assigned to the lid element (3) and an inner housing (5), wherein the chamber (4) and the inner housing (5) have closing and opening elements that correspond to one another and interact with one another in such a way that a medium contained in the chamber (4) can exit into the container (2) due to a movement of the lid element (3) relative to the inner housing (5), wherein the chamber (4) has a freely projecting closure edge, which in a usage state is directed into a container interior, circumferentially extends around the central axis of the chamber (4) in an annular manner and in the closed state interacts with the inner housing (5) in a closing manner, wherein the inner housing (5) forms a chamber bottom (14) that is delimited by the closure edge, wherein the chamber (4) furthermore is composed of two parts (8, 9) and has a partition plane (E) that extends perpendicular to a vertical central axis (x) of the closure device (1), and wherein the partition plane (E) extends through an overlapping section (41) of the lower part (9) of the chamber (4), or the closure device (1) according to claim 1, wherein the two parts (8, 9) are welded to one another in the partition plane (E), wherein the welded joint is produced by a supplementary section (36) that is connected to both parts (8, 9) and produced by overmoulding, wherein the supplementary section (36) is designed annularly, and wherein a cross-sectionally outer circumferential wedge surface is cut into the edge region of the upper part (8) in order to accommodate the supplementary section (36) produced by overmoulding the region or that the supplementary section (36) is with respect to a cross section protracted radially outward and accordingly protrudes beyond the facing outer edge delimitation of the upper and the lower part (8, 9).

3. The closure device according to claim 1, wherein the interlock (6) is formed on a free-standing cylinder section (42) of the inner housing (5).

4. The closure device according to claim 1, wherein the chamber (4) consists of a vertically upper part (8) and a vertically lower part (9) and is interlocked with the lid element (3) and the inner housing (5) on two planes (F, G), which with respect to the usage state of the closure device (1) are separated from one another in the vertical direction (M), by forming catch projections (30, 32) and catch recesses (31, 33) on the chamber (4), the lid element (3) and the inner housing (5), wherein the interlock (6) with the inner housing (5) is with respect to the vertical central axis (x) of the closure device (1) offset radially inward relative to the interlock (7) with the lid element (3), and wherein the catch projections (30, 32) and catch recesses (31, 33) of the planes (F, G) extend without overlapping one another in a projection into a common plane (H) transverse to the vertical axis (x).

5. The closure device according to claim 4, wherein the catch projections (30, 32) are formed on the vertically lower part (9).

6. The closure device according to claim 5, wherein both parts (8, 9) consist of a rigid plastic.

7. The closure device according to claim 6, wherein both parts (8, 9) contain polybutylene terephthalate.

8. The closure device according to claim 2, wherein the supplementary section (36) is designed with a rear engagement (37, 38) with respect to a vertical section, in which the vertical central axis (x) is illustrated in the form of a line.

9. The closure device according to claim 2, wherein the supplementary section (36) is designed essentially triangular or trapezoidal with respect to the vertical section.

10. The closure device according to claim 2, wherein the supplementary section (36) clamps together the two parts (8, 9) in the vertical direction.

11. A closure device (1) for a container (2) with a container opening (10), comprising: a lid element (3) configured for closing the container opening (10), a chamber (4) assigned to the lid element (3) and an inner housing (5), wherein the chamber (4) and the inner housing (5) have closing and opening elements that correspond to one another and interact with one another in such a way that a medium contained in the chamber (4) can exit into the container (2) due to a rotational movement of the lid element (3) relative to the inner housing (5), wherein the chamber (4) has a freely projecting closure edge, which in a usage state is directed into a container interior, circumferentially extends around a central axis of the chamber (4) in an annular manner and in the closed state interacts with the inner housing (5) in a closing manner, wherein the inner housing (5) forms a chamber bottom (14) that is delimited by the closure edge, the chamber bottom transforming into a channel (15) over a circumference, channel being delimited by a radially inner channel sidewall 16 and a radially outer channel sidewall (17), wherein the chamber (4) is interlocked with the inner housing (5), and wherein the interlock (6) with the inner housing (5) is with respect to a vertical central axis (x) of the closure device (1) offset radially inward in relation to a greatest width (k) of the chamber (4) in an offset direction (L), wherein the interlock (6) is in the vertical direction (M) designed separately from a shoulder section (40) of the inner housing (5), which is formed on the bottom side underneath the interlock (6) and functionally connected to the container opening (10), and wherein the shoulder section (40) is connected to a region of an upper end of the radially outer channel sidewall (17) and extends along an upward arc into a collar (12) that extends transverse to the vertical axis and rests on an upper rim of the container opening.

* * * * *